US010205232B2

(12) United States Patent
Sayama et al.

(10) Patent No.: US 10,205,232 B2
(45) Date of Patent: Feb. 12, 2019

(54) MULTI-ANTENNA AND RADIO APPARATUS INCLUDING THEREOF

(71) Applicant: ASAHI GLASS COMPANY, LIMITED, Chiyoda-ku (JP)

(72) Inventors: Toshiki Sayama, Chiyoda-ku (JP); Ryuta Sonoda, Chiyoda-ku (JP); Koji Ikawa, Chiyoda-ku (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 15/361,920

(22) Filed: Nov. 28, 2016

(65) Prior Publication Data

US 2017/0077599 A1 Mar. 16, 2017

Related U.S. Application Data

(63) Continuation of application No. PCT/JP2015/065315, filed on May 27, 2015.

(30) Foreign Application Priority Data

May 30, 2014 (JP) ..... 2014-113074

(51) Int. Cl.
*H01Q 1/24* (2006.01)
*H01Q 1/52* (2006.01)
(Continued)

(52) U.S. Cl.
CPC ..... *H01Q 1/52* (2013.01); *H01Q 1/48* (2013.01); *H01Q 1/523* (2013.01); *H01Q 3/24* (2013.01); *H01Q 9/42* (2013.01); *H01Q 21/28* (2013.01)

(58) Field of Classification Search
CPC .. H01Q 1/24; H01Q 1/48; H01Q 3/24; H01Q 1/52; H01Q 9/42; H01Q 21/28
See application file for complete search history.

(56) References Cited

U.S. PATENT DOCUMENTS 7,212,164 B2 5/2007 Miyano et al.
7,233,289 B2 6/2007 Chung et al.
(Continued)

FOREIGN PATENT DOCUMENTS

CN 102959802 A 3/2013
EP 2584649 A1 4/2013
(Continued)

OTHER PUBLICATIONS

International Search Report dated Jun. 30, 2015 in PCT/JP2015/065315 filed May 27, 2015 (with English translation).
(Continued)

*Primary Examiner* — Dieu H Duong
(74) *Attorney, Agent, or Firm* — Oblon, McClelland, Maier & Neustadt, L.L.P.

(57) ABSTRACT

A multi-antenna includes a ground plane; a first feeding point; a second feeding point that is different from the first feeding point; a first feed element that is connected to the first feeding point; a second feed element that is connected to the second feeding point, a cancellation electric current being generated in the second feed element; and a radiating element that functions as a radiation conductor when power is supplied by establishing electromagnetic field coupling with the first feed element and the second feed element.

20 Claims, 22 Drawing Sheets

(51) Int. Cl.

| | |
|---|---|
| ***H01Q 3/24*** | (2006.01) |
| ***H01Q 21/28*** | (2006.01) |
| ***H01Q 1/48*** | (2006.01) |
| ***H01Q 9/42*** | (2006.01) |

(56) References Cited

U.S. PATENT DOCUMENTS

| | | | | |
|---|---|---|---|---|
| 7,411,557 | B2 | 8/2008 | Shimizu et al. | |
| 8,854,267 | B2 | 10/2014 | Kim et al. | |
| 2008/0266190 | A1 | 10/2008 | Ohba et al. | |
| 2012/0306718 | A1 | 12/2012 | Koyanagi et al. | |
| 2013/0082898 | A1 | 4/2013 | Asanuma et al. | |
| 2013/0099980 | A1 | 4/2013 | Hayashi et al. | |
| 2013/0257674 | A1* | 10/2013 | Li | H01Q 5/321 343/853 |
| 2013/0271339 | A1* | 10/2013 | Mikata | H01Q 1/50 343/850 |
| 2014/0327584 | A1 | 11/2014 | Chang | |
| 2015/0130669 | A1 | 5/2015 | Sonoda et al. | |

FOREIGN PATENT DOCUMENTS

| | | | |
|---|---|---|---|
| JP | 2005-57723 | | 3/2005 |
| JP | 2007-221344 | | 8/2007 |
| JP | 2011-109547 | A | 6/2011 |
| JP | 2012-175317 | A | 9/2012 |
| JP | 5076019 | | 11/2012 |
| JP | 2013-214953 | | 10/2013 |
| JP | 2013-223125 | | 10/2013 |
| JP | 5323271 | | 10/2013 |
| WO | WO 2007/043150 | A1 | 4/2007 |
| WO | WO 2011/102143 | A1 | 8/2011 |
| WO | WO 2014/013840 | A1 | 1/2014 |

OTHER PUBLICATIONS

Written Opinion dated Jun. 30, 2015 in PCT/JP2015/065315 filed May 27, 2015.

Angus C. K. Mak, et al., "Isolation Enhancement Between Two Closely Packed Antennas", IEEE Transactions on Antennas and Propagation, vol. 56, (11), 2008, 9 pgs.

Andre Kurs, et al., "Wireless Power Transfer via Strongly Coupled Magnetic Resonances", Science Express, vol. 317, 2007, 4 pgs.

* cited by examiner

CROSS-SECTION ALONG A-A'

CROSS-SECTION ALONG B-B'

CROSS-SECTION ALONG C-C'

CROSS-SECTION ALONG A-A'

CROSS-SECTION ALONG B-B'

CROSS-SECTION ALONG C-C'

CROSS-SECTION ALONG A-A'

CROSS-SECTION ALONG B-B'

CROSS-SECTION ALONG C-C'

MULTI-ANTENNA AND RADIO APPARATUS INCLUDING THEREOF

CROSS-REFERENCE TO RELATES APPLICATION

The present application is a continuation application filed under 35 U.S.C. 111(a) claiming benefit under 35 U.S.C. 120 and 365(c) of PCT International Application No. PCT/JP2015/065315 filed on May 27, 2015 and designating the U.S., which claims priority of Japanese Patent Application No. 2014-113074 filed on May 30, 2014. The entire contents of the foregoing applications are incorporated herein by reference.

BACKGROUND OF THE INVENTION

1. Field of the Invention

The present invention relates to a multi-antenna and a radio apparatus including thereof (e.g., a portable radio apparatus, such as a mobile phone).

2. Description of the Related Art

In recent years, wireless technology has been spread which is for a multi-antenna including multiple antennas, such as a diversity antenna and MIMO; and a technique has been demanded that is for enhancing isolation of multi-antennas. Furthermore, for an antenna to be installed in a radio apparatus, such as a mobile phone and a mobile device, downsizing has been demanded in accordance with downsizing of mobile devices.

As a technique for enhancing isolation, a method has been reported in Non-Patent Document 1 such that, compared to FIG. 12A of related art, by newly locating a parasitic element C between antenna elements (dipoles) A and B, as illustrated in FIG. 12B, additional coupling paths are created so as to generate a cancellation electric current.

Additionally, as another technique for enhancing isolation, an antenna has been proposed in Patent Document 1 that includes antenna units 120 and 130; a coupling conductor line 140; and, further, a ground conductive line 150, as illustrated in FIG. 13. Here, a method has been reported such that, by providing the coupling conductor line 140 and the ground conductive line 150, interference between resonance modes excited by the antenna units 120 and 130 is reduced.

Alternatively, as a technique for enhancing isolation while reducing reduction of a space, an antenna has been proposed in Patent Document 2 that is adapted for multiple frequencies by causing feed elements 510 and 520, and a parasitic element 530 to be coupled in a contactless manner, as illustrated in FIG. 14. Specifically, a method has been reported in Patent Document 2 that is for causing capacitive coupling to a parasitic element.

PRIOR ART DOCUMENTS

Non-Patent Documents

Non-Patent Document 1: A. C. K. Mak, et al., "Isolation Enhancement Between Two Closely Packed Antennas," IEEE Trans. Antennas Propag., vol. 56, no. 11, November 2008, pp. 3411-3419

Patent Documents

Patent Document 1: Japanese Unexamined Patent Publication No. 2013-214953

Patent Document 2: Japanese Unexamined Patent Publication No. 2013-223125

In the configuration of above-described Non-Patent Document 1, however, in addition to the antenna elements A and B, the parasitic element C is required as illustrated in FIG. 12B, and a number of parts increases, so that implementability may be reduced.

Furthermore, as in above-described Patent Document 1 illustrated in FIG. 13, in order to reduce interference of resonance modes excited by the antenna units 120 and 130, it is required to provide the coupling conductor line 140 and the ground conductive line 150, and a number of parts increases, so that implementability may be reduced.

As illustrated in FIG. 14, in a feeding method, as in above-described Patent Document 2, for causing capacitive coupling between the parasitic element (a radiation conductor) 530 that is a radiation conductor and the feed element 510, there are many restrictions, such as arrangements and shapes of the feed elements and the parasitic element. Consequently, due to an error during manufacturing, a relative positional relationship between the radiation conductor and a capacitive plate, such as an interval LG, and intervals LA, LB, LC, and LF, may deviate from a design value and thereby a capacity value is significantly varied, so that impedance matching may not be achieved. In addition, the same may occur, if the relative positional relationship between the parasitic element and the feed element is varied due to oscillation caused by use. In this manner, robustness of the capacitive coupling is low against a positional shift between the feed element and the parasitic element.

There is a need for a multi-antenna and a radio apparatus including the multi-antenna, with which high isolation can be obtained without reducing implementability and positional robustness.

SUMMARY OF THE INVENTION

According to an aspect of the present invention, there is provided a multi-antenna including a ground plane; a first feeding point; a second feeding point that is different from the first feeding point; a first feed element that is connected to the first feeding point; a second feed element that is connected to the second feeding point, a cancellation electric current being generated in the second feed element; and a radiating element that functions as a radiation conductor when power is supplied by establishing electromagnetic field coupling with the first feed element and the second feed element.

According to an aspect of the present invention, a multi-antenna and a radio apparatus including the multi-antenna can be provided with which high isolation can be obtained without reducing implementability and positional robustness.

DESCRIPTION OF THE PREFERRED EMBODIMENTS

First Embodiment

Figure 1:
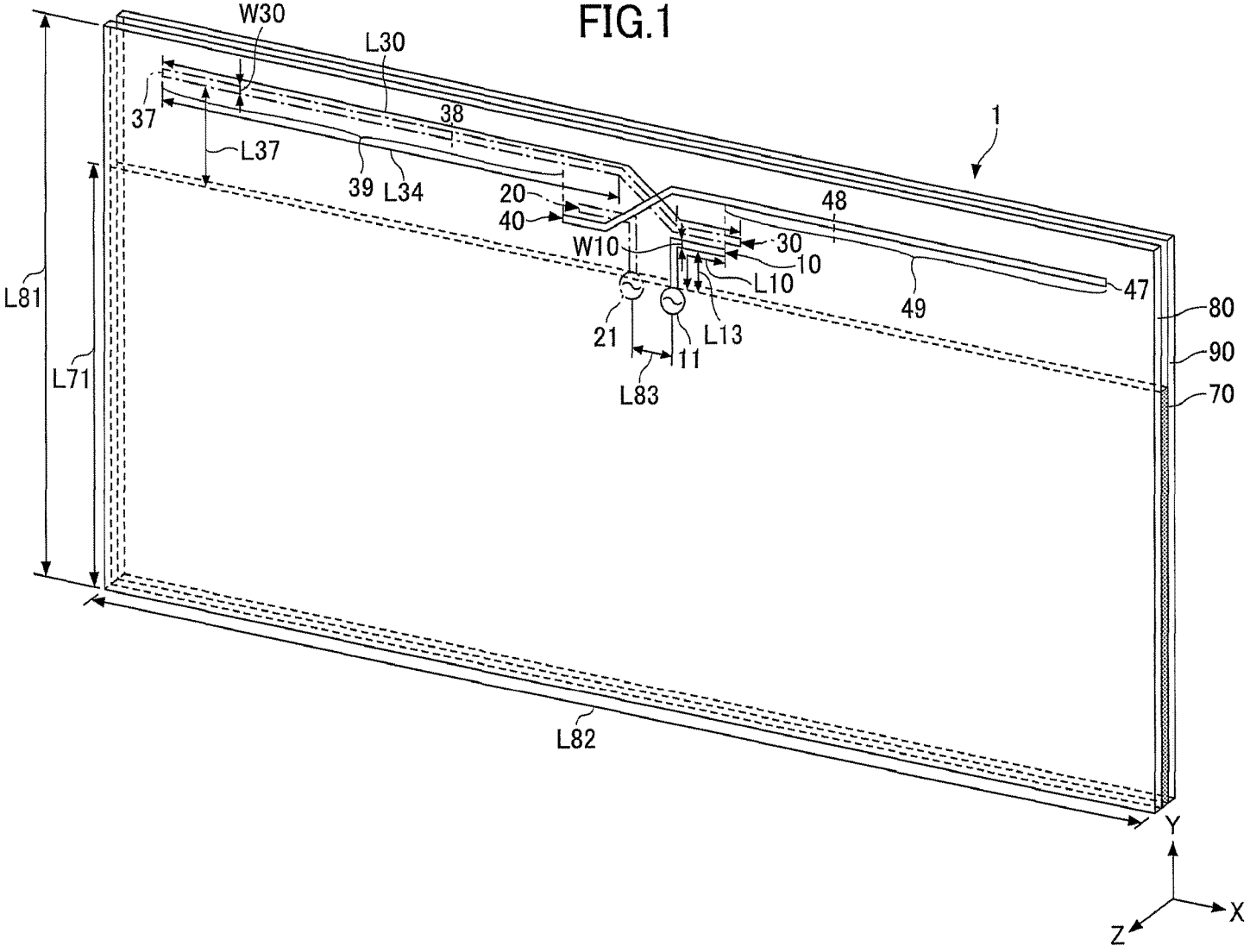
FIG. 1 is a perspective view illustrating an example of an analysis model of an antenna device according to an embodiment of the present invention.

FIG. 1 is a perspective view illustrating a simulation model on a computer for analyzing operation of an antenna device 1 according to a first embodiment of the present invention. As an electromagnetic field simulator, Microwave Studio (registered trademark) (CST Computer Simulation Technology AG) was used.

An antenna device 1 includes a first feeding point 11; a second feeding point 21; a ground plane 70; a first feed element 10; a second feed element 20; a first radiating element 30; and a second radiating element 40. The first feed element 10 is a feeding part for the first radiating element 30 as a separate item and the second feed element 20 is a feeding part for the second radiating element 40 as a separate item, so that these are not the feeding parts of the antenna device 1. The feeding parts of the antenna device 1 are the two feeding parts that are the first feeding part 11 and the second feeding part 21; and the antenna device 1 is a multi-antenna.

The first feeding part 11 and the second feeding part 21 are feeding parts to be connected to a predetermined transmission line utilizing the ground plane 70; a feeder; and so forth. As specific examples of the predetermined transmission line, there are a microstrip line; a strip line; a coplanar waveguide with a ground plane (a coplanar waveguide in which the ground plane is located on a surface opposite to a conductive surface), and so forth. As the feeder, there are a feeder line and a coaxial cable.

In the embodiment, the first feeding point 11 and the second feeding point 21 are located, for example, in the vicinity of a center portion of an outer edge portion 71 of the ground plane 70; and are located on different surfaces of the ground plane 70, so that they have a symmetrical shape with the center portion as the axis.

The ground plane 70 is nipped between a first substrate 80 and a second substrate 90, which are two substrates. The first substrate 80 and the second substrate 90 respectively include the feed points 11 and 21 having the ground plane 70 as a ground reference. For the case of FIG. 1, the ground plane 70 is a part that is nipped between the substrate 80 and the substrate 90 to be formed as an inner layer; however, it is not limited to this. In the embodiment, on the first substrate 80 (the near side), the first feed element 10 and the second radiating element 40 are provided; and, on the second substrate 90 (the far side), the second feed element 20 and the first radiating element 30 are provided.

Figure 2:
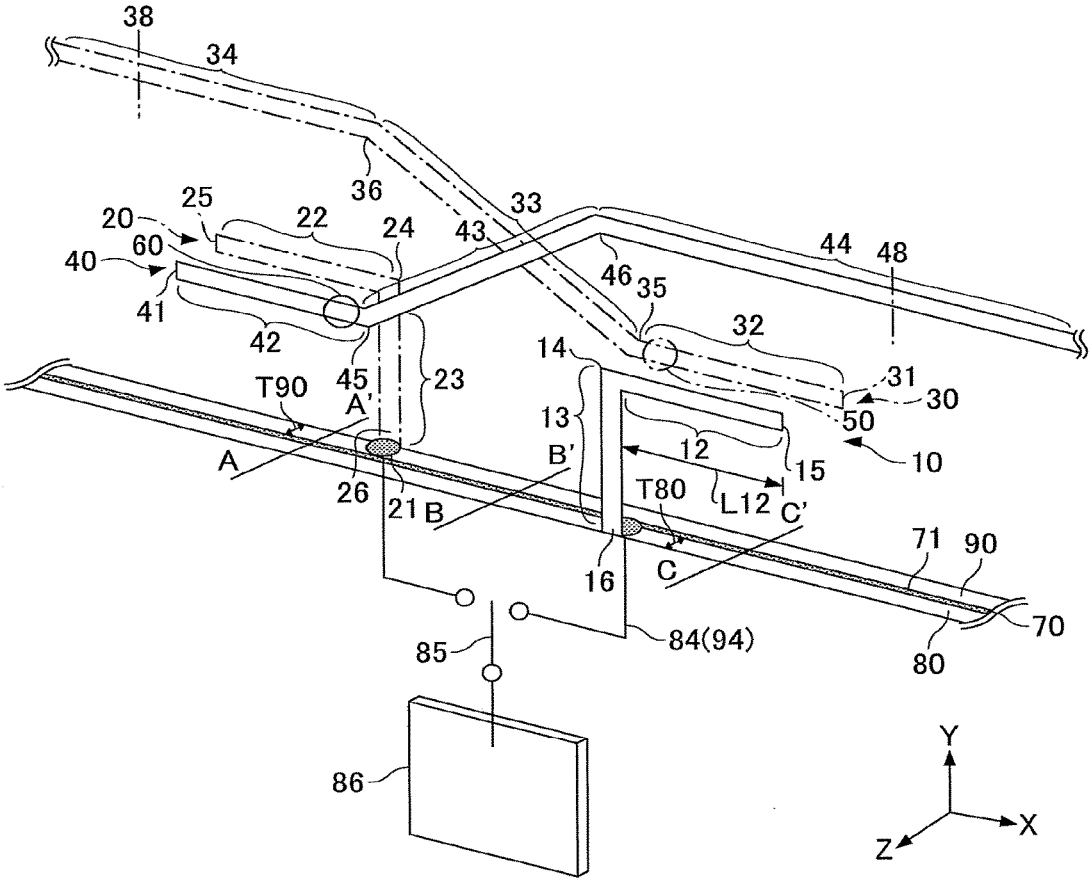
FIG. 2 is an enlarged view of main parts of FIG. 1.

FIG. 2 is an enlarged view of main parts of the antenna device 1 of FIG. 1. The first feed element 10 and the second feed element 20 are conductors respectively connected to the first feeding point 11 and the second feeding point 21 having the ground plane 70 as the ground reference.

As illustrated in FIG. 2, the first feed element 10 and the second feed element 20 are conductors that are arranged to be separated from the radiating element 30 and the radiating element 40 by a predetermined distance, respectively. In the embodiment, the first feed element 10 is arranged to be separated from the radiating element 30, and the second feed element 20 is arranged to be separated from the radiating element 40 by an interval having a directional component parallel to the Z-axis, respectively, namely, to be separated by an amount corresponding to the ground plane 70, and the substrates 80 and 90, respectively. However, positions in the height direction parallel to the Z-axis of the feed elements 10 and 20, the radiating elements 30 and 40, and the ground plane 70 may all be the same as in FIG. 2, or only a part of them may be the same, or may be mutually different.

Through the first feeding point 11, the first feed element 10 is connected to, and through the second feeding point 21, the second feed element 20 is connected to a feeder circuit 86 to be implemented (e.g., an integrated circuit, such as an IC chip, which is not depicted), for example. For example, the feeder circuit 86 may be collectively implemented on any one of the first substrate 80 (the near side of FIG. 2) or the second substrate 90 (the far side of FIG. 2); or feeder circuits corresponding to the feed elements 10 and 20 may be respectively implemented on the first substrate 80 and the second substrate 90. Alternatively, the feeder circuit 86 may be located outside the substrates 80 and 90; and may be connected to the feeding points 11 and 21 of the antenna device 1 through wire. The first feeding point 11, the second feeding point 21, and the feeder circuit 86 may, at least, include a switch element or be connected to a switch element 85; and may further be connected through the above-described different multiple types of transmission lines and feeders.

Here, the substrate 80 may include a transmission line provided with a strip conductor 84 for connecting the above-described switch element 85 to the feeding point 11.

The strip conductor 84 is a signal line formed on a surface (inner surface) of the substrate 80 so as to nip the substrate 80 in the space to the ground plane 70, for example. Similarly, the substrate 90 may include a transmission line provided with a strip conductor 94 for connecting the switch element 85 to the feeding point 21. The strip conductor 94 is a signal line formed on a surface (inner surface) of the substrate 90 so as to nip the substrate 90 in the space to the ground plane 70, for example.

The switch element 85 is an element for alternatively selecting any one of the first feed element 10 and the second feed element 20 to connect to the feeder circuit 86. The switch element 85 is located on the substrate 80 or 90; and is connected to the feeder circuit 86. For a case of exciting the first feed element 10, the feeder circuit 86 is caused to be connected to the feeding point 11 connected to a feeding point side edge 16 of the first feed element 10, and the feeding point 21 connected to the second feed element 20 is caused to be an open end by the switch element 85. For a case of exciting the second feed element 20, the feeder circuit 86 is caused to be connected to the feeding point 21 connected to a feeding point side edge 26 of the second feed element 20; and the feeding point 11 connected to the first feed element 10 is caused to be an open end by the switch element 85. In this manner, by the switch element 85, excitation by the first feed element 10 and excitation by the second feed element 20 can be complementary switched.

In the feeder circuit 86, by setting in such a manner that the feeding point 11 and the feeding point 21 are to be excited by different matching characteristics, such as those on a space, a frequency, a polarization plane, and a time, and by switching by the switch element 85 so as to follow the setting, a diversity function of the antenna device 1 can be achieved. Accordingly, the antenna device 1 can make a selection at each occasion, so that a radio wave of an antenna with a better communication state can be adopted.

By utilizing multiple radiating elements 30 and 40, multi-band characteristics, wide-band characteristics, directivity control, and so forth can be facilitated. Furthermore, multiple antennas may be installed in a single radio apparatus (a radio communication device). Alternatively, the radiating elements may be common between the first feed element 10 and the second feed element 20.

Since two feeding points 11 and 21 are provided, the antenna device 1 can function as a MIMO (Multiple Input Multiple Output) antenna. Furthermore, even if both the first feed element 10 and the second feed element 20 are excited by the two feeding points 11 and 21, the antenna 1 can maintain isolation between the first feeding point 11 and the second feeding point 21 to be high.

Here, for the case of the embodiment, the feed elements 10 and 20, and the radiating elements 30 and 40 are installed on the surfaces of the substrates 80 and 90, as illustrated in FIG. 2; however, they may be installed inside the substrates 80 and 90. For example, a chip component that is formed to include the feed elements 10 and 20, and a medium contacting the feed elements 10 and 20 are implemented on the substrate 80 and/or 90. In this manner, the feed elements 10 and 20 contacting the medium can be easily implemented on the substrates 80 and 90.

The substrates 80 and 90 are substrates formed of a dielectric, a magnetic material, or a mixture of a dielectric and a magnetic material, as a base material. As specific examples of the dielectric, there are a resin, glass ceramics, LTCC (Low Temperature Co-Fired Ceramics), alumina, and so forth. As a specific example of the mixture of the dielectric and the magnetic material, it suffices if it includes any of a metal or an oxide including a transition element, such as Fe, Ni, and Co, and a rare-earth element, such as Sm and Nd; and, for example, there are hexagonal ferrite, spinel ferrite (e.g., Mn—Zn ferrite, Ni—Zn ferrite), garnet ferrite, permalloy, Sendust (registered trademark), and so forth.

Alternatively, for a case where the radiating elements 30 and 40 are formed on a cover glass of, for example, a smartphone (radio apparatus), the radiating elements 30 and 40 may preferably be formed by pasting conductor paste, such as copper and silver, on a surface of the cover glass and by baking it. Here, as the conductor paste, conductor paste may preferably be used that can be baked at a low temperature to the extent that strengthening of the chemically strengthened glass to be utilized for the cover glass is not reduced at that temperature. Furthermore, in order to prevent deterioration of the conductor by oxidation, plating may be applied. Furthermore, decorative printing may be applied to the cover glass, and a conductor may be formed on the portion where decorative printing is applied. Further, for a case where a black shielding film is formed on a fringe of the cover glass, for example, for purposes of hiding wiring, the radiating elements 30 and 40 may be formed on the black shielding film.

Figure 3A:
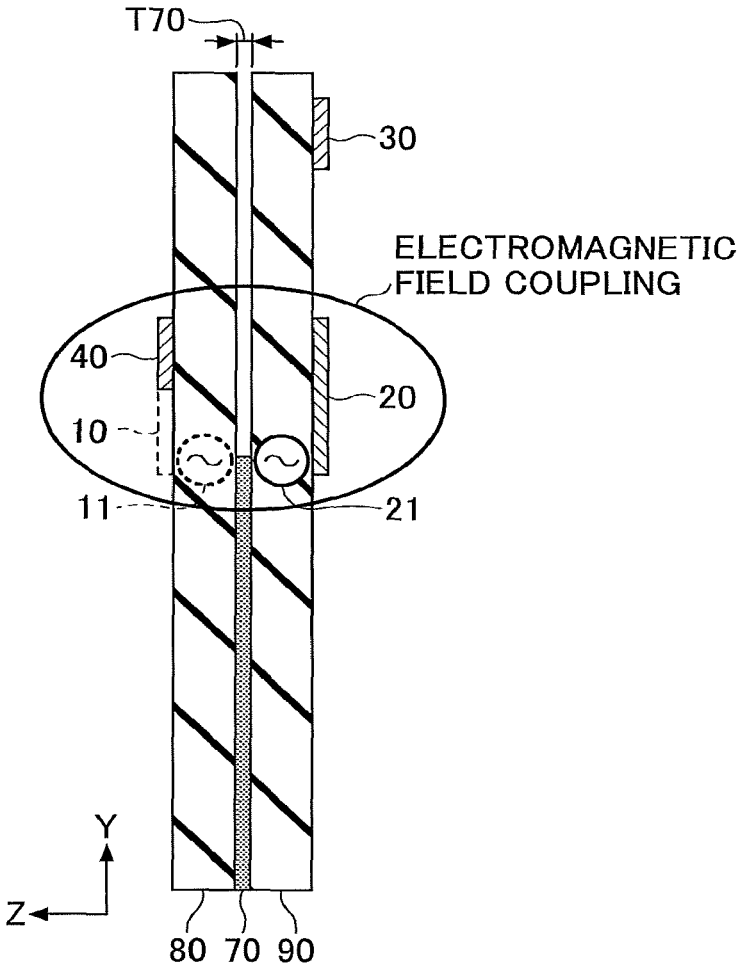
FIG. 3A is a cross-sectional view along A-A' in a YZ direction of the antenna device of FIG. 2.
Figure 3B:
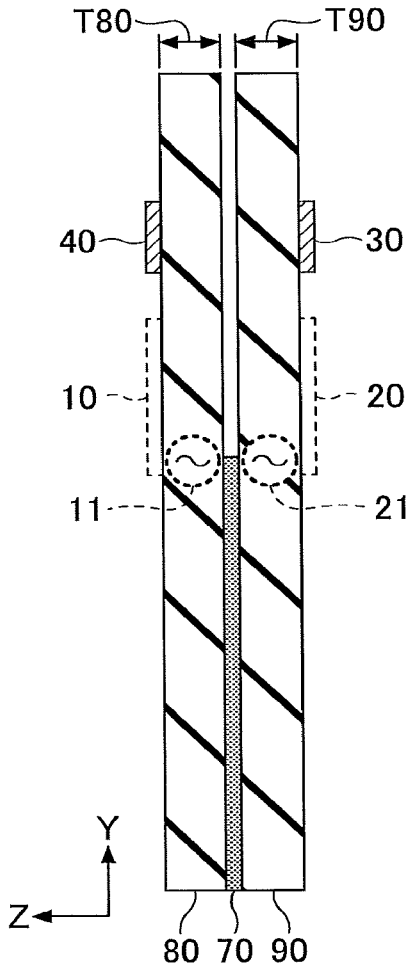
FIG. 3B is a cross-sectional view along B-B' in the YZ direction of the antenna device of FIG. 2.
Figure 3C:
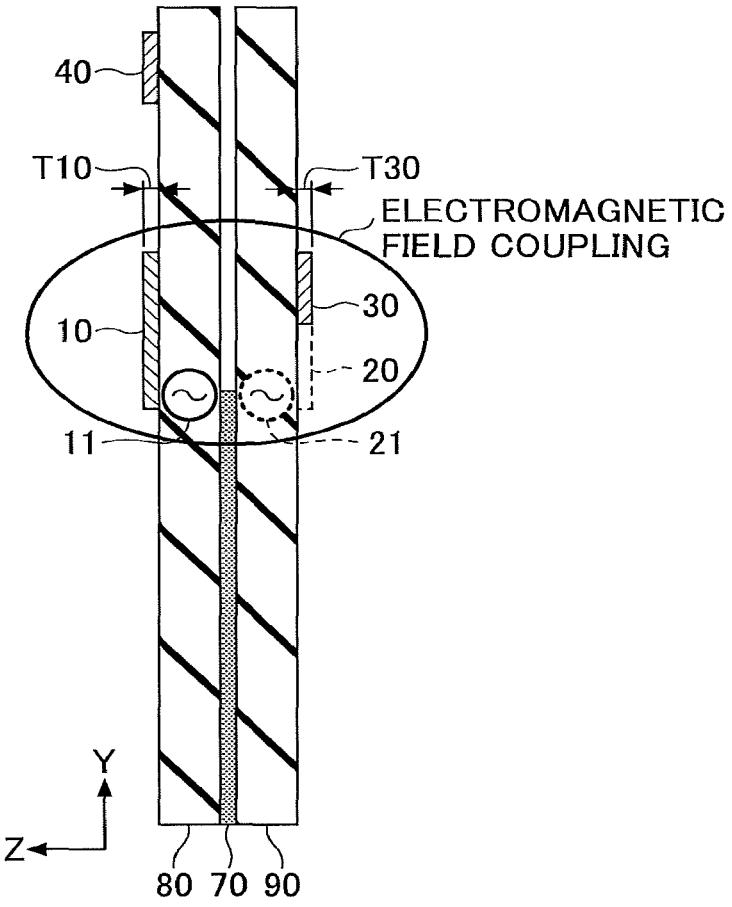
FIG. 3C is a cross-sectional view along C-C' in the YZ direction of the antenna device of FIG. 2.

FIGS. 3A through 3C illustrate cross-sections in a YZ axis direction of a main part of the antenna device 1 of FIG. 1 and FIG. 2. Specifically, FIG. 3A illustrates a cross section along A-A', FIG. 3B illustrates a cross section along B-B', and FIG. 3C illustrates a cross section along C-C' of the antenna device 1 illustrated in FIG. 2. In the embodiment illustrated in FIG. 1 through FIG. 3C, the first feed element 10 overlaps the first radiating element 30 in a plan view in a direction parallel to the Z-axis; and the second feed element 20 overlaps the second radiating element 40 in a plan view in the direction parallel to the Z-axis. However, they may not necessarily be overlapped in the plan view in the direction parallel to the Z-axis, as long as the first feed element 10 and the first radiating element 30, and the second feed element 20 and the second radiating element 40 are respectively separated by a distance with which power can be fed in a contactless manner. Alternatively, they may be overlapped in a plan view in any direction, such as a direction parallel to the X-axis or the Y-axis. Arrangement configurations other than those of the feed elements and the radiating elements are described below as another embodiment.

The first feed element 10 is an example of a feed element connected to the feeding point 11 with the ground plane 70 as the ground reference. The first feed element 10 is a conductor such that power can be fed to it when it is coupled to the first radiating element 30 in a contactless manner and in a high frequency manner. The second feed element 20 is an example of a feed element connected to the feeding point 21 with the ground plane 70 as the ground reference. The second feed element 20 is a conductor such that power can be fed to it when it is coupled to the radiating element 40 in a contactless manner and in a high frequency manner.

The first and second feed elements 10 and 20 are, for example, linear conductors arranged so that at least a part of the feed elements 10 and 20 does not overlap the ground plane 70 in a plan view in a normal direction of the ground plane 70. For the case of FIG. 1, the normal direction of the ground plane 70 is the direction parallel to the Z-axis.

The first and second feed elements 10 and 20 respectively include feeding point connecting parts 13 and 23, and end parts 12 and 22. A bending part 14 is provided between the feeding point connection part 13 and the end part 12, and the feeding point connecting part 13 and the end part 12 have a continuous shape with an angle of 90 degrees; and a bending part 24 is provided between the feeding point connection part 23 and the end part 22, and the feeding point connecting part 23 and the end part 22 have a continuous shape with an angle of 90 degrees.

The first and second feed elements 10 and 20 are linear conductors including linear conductor portions, respectively. The feeding point connecting parts 13 and 23 are first extended, for example, to the bending parts 14 and 24 from the feeding points 11 and 21 as the starting points, respectively, in the direction separated from an outer edge portion 71 of the ground plane 70 parallel to the XY plane. The end parts 12 and 22 are linear conductors that extend from the bending parts 14 and 24 to edges 15 and 25, respectively.

In FIG. 1 and FIG. 2, the feeding point connection parts 13 and 23 of the feed elements 10 and 20 are exemplified, which extend in a direction parallel to the ground plane 70 and perpendicular to the outer edge portion 71. For the case of FIG. 1, the direction parallel to the ground plane 70 and perpendicular to the outer edge portion 71 is the direction parallel to the Y-axis. The bending parts 14 and 24 are parts at which extending directions are changed from the directions perpendicular to the outer edge portion 71 (Y-axis direction) to the direction toward the edges 15 and 25 (X-axis direction).

Furthermore, the end parts 12 and 22 of the feed elements 10 and 20 are extended toward the edges 15 and 25 in a direction to separated from the bending parts 14 and 24 and parallel to the X-axis direction. For the case of FIG. 1, the first and second feed elements 10 and 20 are point-symmetric in the lateral direction and in the thickness direction.

In FIG. 1, the two feed elements 10 and 20 are exemplified, which are arranged in the XY plane and which have L-shapes; however, in the feed elements 10 and 20, the angles of the bending parts 14 and 24 may not be 90 degrees, and the feed elements 10 and 20 may have any other shapes, such curved shapes or linear shapes. Furthermore, the feed elements 10 and 20 may be conductors provided with conductor parts that extend within the XY plane of the substrates 80 and 90; and conductor parts that extend within a plane (the inner surfaces of the substrates or inner parts) other than the XY plane.

The first radiating element 30 is arranged to separate from the first feed element 10; and is an example of a radiating element that function as a radiation conductor, upon receiving feeding of power by establishing electromagnetic field coupling (electromagnetic field resonant coupling) with the first feed element 10. Namely, the first radiating element 30 receives feeding of power as a result that the first feed element 10 resonates, and functions as a radiation conductor. The first radiating element 30 is a linear conductor provided with a feeding part 50 that receives feeding of power from the first feed element 10 in a contactless manner. In FIG. 1 through FIG. 3C, the first radiating element 30 and the first feed element 10 are located to be separated by a distance with which they can mutually establish electromagnetic field coupling.

In the embodiments illustrated in FIG. 1 through FIG. 3C, the first radiating element 30 is a conductor having a folded line shape, and includes a first parallel part 32 that is a part extending from an edge 31 to a bending part 35; an inclined part 33 that extends from the bending part 35 to a bending part 36 so as to separate from the first parallel part 32; and a second parallel part 34 that is a part extending from the bending part 36 to an edge 37. The second parallel part 34 is in proximity to and extends in parallel with the end part 22 of the second feed element 20.

Specifically, the radiating element 30 has a continuous shape provided with two bending parts 35 and 36; and between the inclined part 33 and the first parallel part 32, the extending direction is changed at the bending part 35. From the bending part 35, which is bent with a predetermined angle, toward the bending part 36, it extends as the inclined part 33 in a direction to separate from the ground plane 70 and the feed element 10. From the bending part 36 toward the edge 37, which is another open end, it is in proximity to and extends in parallel with the end part 22 of the second feed element 20, as the second parallel part 34. Specifically, the first radiating element 30 includes the second parallel part 34, which is in the vicinity of the end part 22 of the second feed element 20, and which extends in a position separated from the ground plane 70 compared to the second feed element 20. Furthermore, the second parallel part 34 includes a part that extends to a part where the second feed element 20 is not located, namely, it includes an extending part 39 (cf. FIG. 1) that is longer than the first feed element 10 and that extends along the outer edge portion 71 of the ground plane 70 toward the side opposite to the first parallel part 32.

Similarly, the radiating element 40 has a continuous shape provided with two bending parts 45 and 46; and between an inclined part 43 and a first parallel part 42, extending direction is changed at the bending part 45. From the bending part 45, which is bent with a predetermined angle, toward the bending part 46, it extends as the inclined part 43 in a direction to separate from the ground plane 70 and the feed element 20. From the bending part 46 toward the edge 47, which is another open end, it is in proximity to and extends in parallel with the end part 12 of the first feed element 10, as the second parallel part 44. Furthermore, the second parallel part 44 includes an extending part 49 (cf. FIG. 1) that is longer than the second feed element 20 and that extends along the outer edge portion 71 of the ground plane 70 toward the side opposite to the first parallel part 42.

Note that the end part 12 of the first feed element 10 is arranged so that it is in parallel with and proximate to a part of or all of the second parallel part 44 of the second radiating element 40. Even if capacitive coupling or electromagnetic field coupling is established between the first feed element 10 and the second radiating element 40, it is significantly small compared to the strength of the electromagnetic field coupling between the first feed element 10 and the first radiating element 30.

As described above, the radiating elements 30 and 40 are, for example, the linear conductors provided with linear radiation conductor parts arranged outside the outer edge portion 71 of the ground plane 70. The radiating element 30 includes, for example, at a side opposite to the ground plane 70 with respect to the outer edge portion 71, the conductor part (the first parallel part) 32 that extends in a direction parallel to the outer edge portion 71 in a state in which it is separated from the outer edge portion 71 by a predetermined shortest distance. For example, the predetermined distance is such that, when a wavelength in vacuum at a resonance frequency of a fundamental mode of the radiating element 30 is assumed to be $\lambda_0$, the shortest distance between the feeding part 50 and the outer edge portion 71 of the ground plane 70, which is the ground reference of the feed point 11, is greater than or equal to $0.0034\lambda_0$ and less than or equal to $0.21\lambda_0$. For the case of FIG. 1, the direction parallel to the outer edge portion 71 is the direction parallel to the X-axis. By the fact that the radiating element 30 is provided with the first parallel part 32 along the outer edge portion 71, for example, positional robustness of the antenna device 1 is enhanced.

In FIG. 1, the radiating element 30 is exemplified that is arranged within the XY plane and that has the folded line shape; however, the radiating element 30 may have another shape, such as a curved shape, a linear shape, and an L-shape. Furthermore, the radiating element 30 may be a conductor provided with a conductor part that extends within the XY plane, and a conductor part that extends within a plane other than the XY plane.

The radiating element 40 may have the same or similar shape as that of the radiating element 30, so that its detailed description is simplified. The radiating element 40 includes one edge 41 and another edge 47; and it is an antenna conductor having a folded line shape that extends while it is folded twice at the bending parts 45 and 46 from the edge 41 to the edge 47. The radiating element 40 includes, for example, at a side opposite to the ground plane 70 with respect to the outer edge portion 71, the conductor part (the first parallel part) 42 that extends in a direction parallel to the outer edge portion 71 in a state in which it is separated from the outer edge portion 71 by a predetermined shortest distance. Similarly, the radiating element 40 further includes the inclined part 43 and the second parallel part 44. The second radiating element 40 configured in such a manner receives feeding of power through electromagnetic field coupling that is caused as a result that the second feed element 20 resonates, and functions as a radiation conductor.

The first radiating element 30 and the second radiating element 40 are conductors that extend in mutually different directions; and these are conductors that extend in the directions to separate from the feed elements 10 and 20, respectively. At this time, by arranging in such a manner that the radiating element 30 and the radiating element 40 intersect in a plan view in a direction parallel to the Z-axis, an implementation area of the antenna device 1 can be reduced. For the case of FIG. 1, the radiating element 30 and the radiating element 40 are conductors arranged within mutually different XY planes; however, they may be conductors arranged within the same plane. Furthermore, for the case of FIG. 1, the radiating element 30 and the radiating element 40 are located on a straight line; however, they may be located on mutually different straight lines. For example, for the case of FIG. 1, in a plan view in a direction parallel to the Z-axis, they may be arranged at a far side and at a near side from the ground plane 70 with respect to the edge 15 of the feed element 10.

The feed element 10 and the radiating element 30 are arranged, for example, to be separated by a distance with which they can mutually establish electromagnetic field coupling; and the feed element 20 and the radiating element 40 are arranged, for example, to be separated by a distance with which they can mutually establish electromagnetic field coupling. The radiating element 30 receives feeding of power in a contactless manner by electromagnetic field coupling at the feeding part 50 through the feed element 10. By receiving feeding of power in such a manner, the radiating element 30 functions as a radiation conductor of the antenna. As illustrated in FIG. 1, when the radiating element 30 is a linear conductor connecting two points, a resonance current (distribution) that is the same as that for a half-wavelength dipole antenna is formed on the radiating element 30. Namely, the radiating element 30 functions as a dipole antenna that resonates at a half-wavelength of a predetermined frequency (which is referred to as a dipole mode, hereinafter). Furthermore, the radiating element may be a loop-shaped conductor. For a case where the radiating element is a loop-shaped conductor, a resonance current (distribution) that is the same as that for a loop antenna is formed on the radiating element. Namely, the radiating element functions as a loop antenna that resonates at a wavelength of a predetermined frequency (which is referred to as a loop mode, hereinafter). Here, the radiating element 40 receives feeding of power in a contactless manner by electromagnetic field coupling at the feeding part 60 through the feed element 20; however, since it is the same as the radiating element 30, its detailed description is omitted.

Electromagnetic field coupling is coupling that utilizes a resonance phenomenon of an electromagnetic field; and, for example, it is disclosed in Non-Patent Document (A. Kurs, et al, "Wireless Power Transfer via Strongly Coupled Magnetic Resonances," Science Express, Vol. 317, No. 5834, pp. 83-86, July 2007.). Electromagnetic field coupling is also referred to as electromagnetic field resonance coupling or electromagnetic field resonant coupling, and which is a technique for causing resonators that resonate at the same frequency to be in proximity to each other and causing one resonator to resonate, so that energy is to be transmitted to the other resonator through coupling in near field (a non-radiated field domain), which is formed between the resonators. Furthermore, electromagnetic field coupling means coupling caused by an electric field and a magnetic field at a high frequency excluding capacitive coupling and electromagnetic induction coupling. Here, excluding capacitive coupling and electromagnetic induction coupling does not imply that these couplings are completely eliminated, and it implies that these are small to the extent that no effect is caused.

By establishing electromagnetic field coupling between the feed element 10 and the radiating element 30, and between the feed element 20 and the radiating element 40, a structure that is strong against impacts is obtained. Namely, by utilizing electromagnetic field coupling, power can be fed to the radiating elements 30 and 40 by using the feed elements 10 and 20, respectively, without physically contacting the feed elements 10 and 20 and the radiating elements 30 and 40, respectively, so that the structure that is strong against impacts is obtained, compared to a contact power feeding method that requires physical contact.

Furthermore, compared to a case where power is fed by capacitive coupling, for a case where power is fed by electromagnetic field coupling, total efficiency (antenna gain) of the radiating elements 30 and 40 at an operating frequency tends not to decrease against variation in clearances (coupling distances) between the feed element 10 and the radiating element 30 and between the feed element 20 and the radiating element 40. Here, total efficiency is a quantity calculated by antenna radiation efficiency×return loss, which is a quantity defined as efficiency of an antenna with respect to input power. Consequently, by establishing electromagnetic field coupling between the feed element 10 and the radiating element 30 and between the feed element 20 and the radiating element 40, degrees of freedom for determining arrangement positions of the feed elements 10 and 20 and the radiating elements 30 and 40 can be enhanced, and positional robustness can also be enhanced.

Recently, as a result of consideration of fitness to a hand, and in order to enhance visibility of a display, and/or to prevent destruction by pressure due to an external cause, a mobile device (a radio apparatus) has been proposed that is provided with flexibility, so that a display and the whole body can be deformed/curved by a predetermined amount to be a curved surface. For an antenna to be installed in such a mobile device, a structure is desirable that is provided with high positional robustness in such a manner that a variation caused by an external factor can be internally compensated for, so that transmission and reception can be performed even if it is curved to some extent.

Here, high positional robustness implies that, even if the arrangement positions of the feed elements 10 and 20 and the radiating elements 30 and 40 are shifted, an effect caused on total efficiency of the radiating elements 30 and 40 is small. Furthermore, since degrees of freedom for determining the arrangement positions of the feed elements 10 and 20 and the radiating elements 30 and 40 are high, it is advantageous in a point that a space required for installation of the antenna 1 can be easily reduced. Furthermore, by utilizing electromagnetic field coupling, power can be fed to the radiating elements 30 and 40 by using the feed elements 10 and 20, respectively, without forming an unnecessary component, such as a capacitive plate, so that power can be fed with a simple configuration, compared to a case of feeding power by capacitive coupling.

Furthermore, for the case of FIG. 1, the feeding part 50 that is a part for the feed element 10 to feed power to the radiating element 30 is located at a part other than a central part 38 between one edge 31 and the other edge 37 of the radiating element 30 (a part between the central part 38 and the edge 31). In this manner, by locating the feeding part 50 at a part of the radiating element 30 other than the part (the central part 38) at which impedance at the resonance frequency of the fundamental mode of the radiating element 30 becomes the lowest, impedance matching of the antenna device 1 can be easily achieved.

The feeding part 50 is a part defined to be closest to the feeding point 11, in the conductor part of the radiating element 30, at which the radiating element 30 and the feed element 10 become closest.

For a case of the dipole mode, impedance of the radiating element 30 becomes higher as a part separates from the central part 38 of the radiating element 30 toward the edge 31 or the edge 37. In electromagnetic coupling, for a case of coupling with high impedance, even if impedance between the feed element 10 and the radiating element 30 is slightly varied, an effect on impedance matching is small, as long as coupling is established with high impedance that is greater than or equal to a certain level. Thus, in order to easily achieve matching, the feeding part 50 of the radiating element 30 is preferably located at a high impedance portion of the radiating element 30.

For example, in order to easily achieve impedance matching of the antenna device 1, it is desirable that the feeding part 50 is located at a part that is separated from the part (the central part 38) at which impedance at the resonance frequency of the fundamental mode of the radiating element 30 becomes the lowest by a distance that is greater than or equal to ⅛ the total length of the radiating element 30 (preferably greater than or equal to ⅙, and more preferably greater than or equal to ¼). For the case of FIG. 1, the total length of the radiating element 30 is the same as the total length L40 of the radiating element 40; and the feeding part 50 is located at the side of the edge 31 with respect to the central part 38.

A feeding part 60 that is a part for the second feed element 20 to feed power to the second radiating element 40 is a part for feeding power to the radiating element 40; however, since it suffices if it has a function that is the same as that of the radiating element 30, the description of its detailed structure is omitted.

Here, for a case where resonance of the fundamental mode of the radiating element is the loop mode, it is desirable that each of the feeding parts 50 and 60 is located at a part within a range that is separated from a part at which impedance at the resonance frequency of the fundamental mode of the radiating element becomes the highest by a distance that is less than or equal to 3/16 the perimeter of the inner circumference of the loop (preferably less than or equal to ⅛, and more preferably less than or equal to 1/16).

Furthermore, assuming that electrical lengths for providing the fundamental mode of resonance of the feed elements 10 and 20 are Le10 and Le20, respectively, electrical lengths for providing the fundamental mode of resonance of the radiating elements 30 and 40 are Le30 and Le40, respectively, and the wavelength on the feed elements 10 and 20 or the radiating elements 30 and 40 at the resonance frequency $f_1$ of the fundamental mode of the radiating elements 30 and 40 is λ, it is preferable that Le10 and Le20 be less than or equal to (3/8)·λ, and when the fundamental mode of resonance of the radiating element 30 is the dipole mode, Le30 and Le40 be greater than or equal to (3/8)·λ and less than or equal to (5/8)·λ, and when the fundamental mode of resonance of the radiating elements 30 and 40 is the loop mode, Le30 and Le40 be greater than or equal to (7/8)·λ and less than or equal to (9/8)·λ.

Le10 and Le20 are preferably less than or equal to (3/8)·λ. Furthermore, for a case where it is desirable to add degrees of freedom to the shape including presence or absence of the ground plane 70, they are preferably greater than or equal to (1/8)·λ and less than or equal to (3/8)·λ; and particularly preferably greater than or equal to (3/16)·λ and less than or equal to (5/16)·λ. It is preferable that Le20 be within this range because the feed elements 10 and 20 favorably resonate at a design frequency of the radiating elements 30 and 40 (the resonance frequency $f_1$), so that the feed elements 10 and 20 are resonant with the radiating elements 30 and 40, respectively, without depending on the ground plane 70 of the antenna device 1, and favorable electromagnetic field coupling can be obtained.

Furthermore, for a case where the ground plane 70 is formed so that the outer edge portion 71 follows the radiating elements 30 and 40, by interaction between the feed elements 10 and 20 and the outer edge portion 71, resonance currents (distributions) can be formed on the feed elements 10 and 20 and the ground plane, and electromagnetic field coupling is established by resonating with the radiating elements 30 and 40. Thus, there are no particular lower limit values for the electrical lengths Le10 and Le20 of the feed element 10 and 20; and it suffices if these are lengths to the extent that the feed elements 10 and 20 can physically establish electromagnetic field coupling with the radiating elements 30 and 40, respectively. Furthermore, the fact that electromagnetic field coupling is achieved implies that matching is achieved. Furthermore, in this case, it is not necessary to design electrical lengths of the feed elements 10 and 20 to be adapted to the resonance frequency of the radiating elements 30 and 40, and the feed elements 10 and 20 can be freely designed as radiation conductors, so that multi-band characteristics of the antenna device 1 can be easily achieved. For example, the feed element 10 and the radiating element 30 may have mutually different resonance frequencies; and the feed element 20 and the radiating element 40 may have mutually different resonance frequencies. Here, it is desirable that the outer edge portion 71 of the ground plane 70 along the radiating elements 30 and 40 together with the electrical lengths of the feed elements 10 and 20 have a length that is greater than or equal to (¼)·λ of a design frequency (a resonance frequency $f_{11}$).

Note that, for a case where no matching circuit is included, assuming that a wavelength of a radio wave in vacuum at a resonance frequency of the fundamental mode of the radiating element is $\lambda_0$ and that a shortening coefficient of a shortening effect by an implementation environment is $k_1$, physical lengths L10 and L20 of the feed elements 10 and 20 are determined by $\lambda_{g1}=\lambda_0 \cdot k_1$. Here, $k_1$ is a value that is calculated from a relative dielectric constant, relative permeability, and a thickness of a medium (environment) of, for example, a dielectric substrate provided with a feed element; a resonance frequency; and so forth, such as an effective relative dielectric constant ($\varepsilon_{r1}$) and effective relative permeability ($\mu_{r1}$) of the environment of the feed element 20. Namely, L20 is less than or equal to $(3/8)\cdot\lambda_{g1}$. The physical lengths L10 and L20 of the feed elements 10 and 20 are the physical lengths for providing Le20; and for an ideal case where no other element is included, they are equal to Le10 and Le20, respectively. For a case where the feed element 20 includes a matching circuit and so forth, it is preferable that L10 and L20 be greater than zero and less than or equal to Le20. By utilizing a matching circuit, such as an inductor, L20 can further be shortened (size can be reduced).

Furthermore, for a case where the fundamental mode of resonance of the radiating element is the dipole mode (a linear conductor such that both ends of a radiating element are open ends), the electrical lengths Le30 and Le40 of the radiating elements 30 and 40 are preferably greater than or equal to $(3/8)\cdot\lambda$ and less than or equal to $(5/8)\cdot\lambda$; more preferably greater than or equal to $(7/16)\cdot\lambda$ and less than or equal to $(9/16)\cdot\lambda$; and particularly preferably greater than or equal to $(15/32)\cdot\lambda$ and less than or equal to $(17/32)\cdot\lambda$. Furthermore, considering a higher order mode, above-described Le31 is preferably greater than or equal to $(3/8)\cdot\lambda\cdot m$ and less than or equal to $(5/8)\cdot\lambda\cdot m$; more preferably greater than or equal to $(7/16)\cdot\lambda\cdot m$ and less than or equal to $(9/16)\cdot\lambda\cdot m$; and particularly preferably greater than or equal to $(15/32)\cdot\lambda\cdot m$ and less than or equal to $(17/32)\cdot\lambda\cdot m$. Here, m is a mode number of the higher mode, and it is a natural number. It is preferable that m be an integer from 1 to 5; and an integer from 1 to 3 are particularly preferable. The case where m=1 is the fundamental mode. It is preferable that Le30 and Le40 be within this range because the radiating elements 30 and 40 sufficiently function as radiation conductors, and efficiency of the antenna device 1 is favorable.

Similarly, for a case where the fundamental mode of resonance of the radiating element is the loop mode (the radiating element is a loop-shaped conductor), above-described Le30 and Le40 are preferably greater than or equal to $(7/8)\cdot\lambda$ and less than or equal to $(9/8)\cdot\lambda$; more preferably greater than or equal to $(15/16)\cdot\lambda$ and less than or equal to $(17/16)\cdot\lambda$; and particularly preferably greater than or equal to $(31/32)\cdot\lambda$ and less than or equal to $(33/32)\cdot\lambda$. Furthermore, for the higher order mode, above-described Le30 and Le 40 are preferably greater than or equal to $(7/8)\cdot\lambda\cdot m$ and less than or equal to $(9/8)\cdot\lambda\cdot m$; more preferably greater than or equal to $(15/16)\cdot\lambda\cdot m$ and less than or equal to $(17/16)\cdot\lambda\cdot m$; and particularly preferably greater than or equal to $(31/32)\cdot\lambda\cdot m$ and less than or equal to $(33/32)\cdot\lambda\cdot m$.

Note that, assuming that a wavelength of a radio wave in vacuum at a resonance frequency of the fundamental mode of the radiating element is $\lambda_0$ and that a shortening coefficient of a shortening effect by an implementation environment is $k_2$, physical lengths L30 and L40 of the radiating elements 30 and 40 are determined by $\lambda_{g2}=\lambda_0 \cdot k_2$. Here, $k_2$ is a value that is calculated from a relative dielectric constant, relative permeability, and a thickness of a medium (environment) of, for example, a dielectric substrate provided with a radiating element; a resonance frequency; and so forth, such as an effective relative dielectric constant ($\varepsilon_{r2}$) and effective relative permeability ($\mu_2$) of the environment of the radiating element 30. Namely, for a case where the fundamental mode of resonance of the radiating element is the dipole mode, L30 and L40 are greater than or equal to $(3/8)\cdot\lambda_2$ and less than or equal to $(5/8)\cdot\lambda_{g2}$; and a case where the fundamental mode of resonance of the radiating element is the loop mode, they are greater than or equal to $(7/8)\cdot\lambda_{g2}$ and less than or equal to $(9/8)\cdot_{g2}$. The physical lengths L30 and L40 of the radiating elements 30 and 40 are the physical lengths for providing Le30 and Le 40, respectively; and for an ideal case where no other element is included, they are equal to Le30 and Le40, respectively. Even for a case where L30 and L40 are shortened by utilizing a matching circuit, such as an inductor, they are preferably greater than zero and less than or equal to Le30 and Le40, respectively; and particularly preferably from 0.4 times to 1 times Le30 and Le40, respectively.

Furthermore, as illustrated in FIG. 1, for a case where interaction between the feed elements 10 and 20 and the outer edge 71 of the ground plane 70 can be utilized, the feed elements 10 and 20 may be caused to function as radiation conductors, as described above. The radiating elements 30 and 40 are radiation conductors that function as $\lambda/2$ dipole antennas, for example, by receiving feeding of power in a contactless manner at the feeding parts 50 and 60 from the feed elements 10 and 20 through electromagnetic field coupling. The feed elements 10 and 20 are linear feeding conductors that can feed power to the radiating elements 30 and 40; however, they are radiating conductors that can function as monopole antennas (e.g., $\lambda/4$ monopole antennas) by receiving feeding of power at the feeding points 11 and 21. By setting the resonance frequency of the radiating elements 30 and 40 to be $f_1$, by setting the resonance frequency of the feed elements 10 and 20 to be $f_2$ that is different from the resonance frequency $f_1$, and by adjusting the lengths of the feed elements 10 and 20 so that they are monopole antennas that resonate at the frequency $f_2$, radiation functions of the feed elements 10 and 20 can be utilized, so that multi-band characteristics of the antenna device 1 can be easily achieved.

For a case where no matching circuit is included, assuming that a wavelength of a radio wave in vacuum at the resonance frequency $f_2$ of the feed elements 10 and 20 is $\lambda_1$ and that a shortening coefficient of a shortening effect by an implementation environment is $k_1$, physical lengths L10 and L20 for utilizing radiation functions of the feed elements 10 and 20 are determined by $\lambda_{g3}=\lambda_1 \cdot k_1$. Here, $k_1$ is a value that is calculated from a relative dielectric constant, relative permeability, and a thickness of a medium (environment) of, for example, a dielectric substrate provided with a feed element; a resonance frequency; and so forth, such as an effective relative dielectric constant ($\varepsilon_{r1}$) and effective relative permeability ($\mu_{r1}$) of the environments of the feed elements 10 and 20. Namely, L20 is less than or equal to $(3/8)\cdot\lambda_{g3}$ and less than or equal to $(3/8)\cdot\lambda_{g3}$; and preferably greater than or equal to $(3/16)\cdot\lambda_{g3}$ and less than or equal to $(5/16)\cdot\lambda_{g3}$. The physical lengths L20 of the feed elements 10 and 20 are the physical lengths for providing Le20; and for an ideal case where no other element is included, it is equal to Le20. For a case where the feed elements 10 and 20 include matching circuits and so forth, it is preferable that the physical lengths L10 and L20 be greater than zero and less than or equal to the electrical lengths Le10 and Le20. By utilizing a matching circuit, such as an inductor, L10 and L20 can further be shortened (size can be reduced).

Furthermore, assuming that a wavelength of a radio wave in vacuum at the resonance frequency of the fundamental mode of the radiating elements 30 and 40 is $\lambda_0$, the shortest distances x between the feed element 10 and the radiating element 30 and between the feed element 20 and the radiating element 40 are preferably less than or equal to $0.2\times\lambda_0$ (more preferably less than or equal to $0.1\times\lambda_0$, and further more preferably less than or equal to $0.05\times\lambda_0$). By arranging the feed elements 10 and 20 and the radiating elements 30 and 40 to be separated by the shortest distance x, respectively, total efficiency of the radiating elements 30 and 40 can be enhanced.

Note that the shortest distances x are the linear distances between the most proximate parts of the feed element 10 and the radiating element 30, and the feed element 20 and the radiating element 40, respectively. Furthermore, the feed element 10 and the radiating element 30, and the feed element 20 and the radiating element 40 may or may not intersects when they are viewed from any angle, as long as electromagnetic field coupling is established between them; and the intersection angle may be any angle.

The positions of the shortest distances x are parts where coupling between the feed element 10 and the radiating element 30 and coupling between the feed element 20 and the radiating element 40 are strong; and, if the distance to be extended with the shortest distance x is long, couplings are established at a part where impedance is high and a part where it is low of each of the radiating elements 30 and 40, so that impedance matching may not be achieved. Thus, it is advantageous from the point of impedance matching that the distance to be extended with the shortest distance x is short, so that strong coupling is established only at a part of each of the radiating elements 30 and 40 where variation in impedance is small.

Specifically, for the case of the dipole mode, the distance to be extended with the shortest distance x is preferably less than or equal to ⅜ the length of each of the radiating element 30 and 40. For example, as an example of the size of FIG. 1, the extended distance x in which electromagnetic coupling is established between the feed element 10 and the radiating element 30 is approximately 2.⅜ the length of the radiating element 30.

For the case of FIG. 1, the shortest distance x is the shortest distance between the end part 12 located between the bending part 14 and the edge 15 of the feed element 10 and the feeding part 50 located at the first parallel part 32 that is located between the bending part 35 and the edge 31 of the radiating element 30. And, it is the shortest distance between the end part 22 located between the bending part 24 and the edge 25 of the feed element 20 and the feeding part 60 located at the first parallel part 42 that is located between the bending part 45 and the edge 41 of the radiating element 40. Note that, when deformation occurs in the substrates 80 and 90, in the radiating elements 30 and 40, it is possible that the locations of the feeding parts 50 and 60 are at the inclined parts 33 and 43, respectively.

The radiating element 30 of FIG. 1 is a radiation conductor that function as an antenna (e.g., a λ/2 dipole antenna) operated in the dipole mode by receiving feeding of power in a contactless manner at the feeding part 50 from the feeding element 10, especially, by receiving feeding of power through electromagnetic field coupling. The same applies to the radiating element 40.

The feed elements 10 and 20 are linear feeding conductors that can feed power to the radiating elements 30 and 40; however, they are radiating conductors that can function as antennas operated in the monopole mode (e.g., λ/4 monopole antennas) by receiving feeding of power at the feeding points 11 and 21.

Since the radiating element 30 is provided with the feeding part 50 at the side close to the edge 31 with respect to the central part 38, it establishes electromagnetic field coupling with the feed element 10 with high impedance. Similarly, since the radiating element 40 is provided with the feeding part 60 at the side close to the edge 41 with respect to the central part 48, it establishes electromagnetic field coupling with the feed element 20 with high impedance.

In a state where matching is achieved between the feed elements 10 and 20 and any of the radiating element 30 and the radiating element 40 with high impedance, namely, in a state where electromagnetic field coupling is established, the directivity of the antenna device 1 is line-symmetric with respect to the YZ plane passing through the middle of the first feed element 10 and the second feed element 20, if the environment is uniform.

Figure 4:
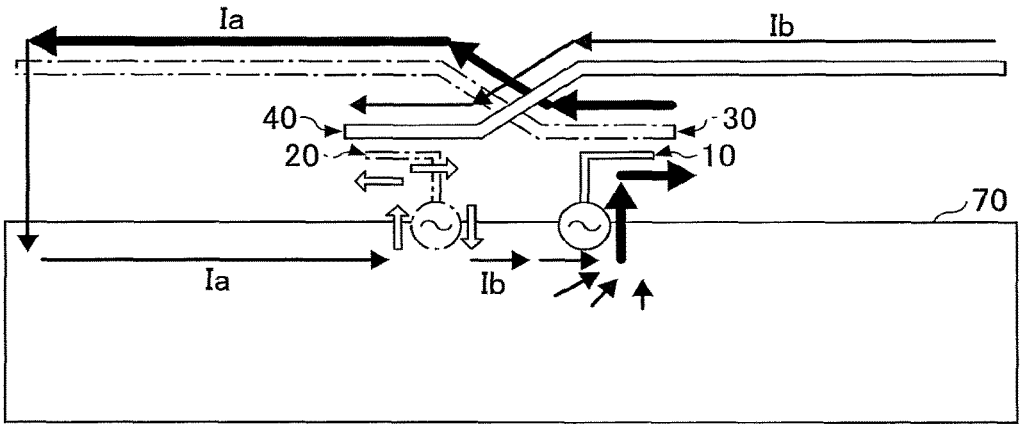
FIG. 4 is a diagram illustrating a flow of an electric current of the antenna of FIG. 1.

FIG. 4 is a simulation diagram illustrating magnitude and a direction of an electric current at a resonance frequency of the radiating element. FIG. 4 is a plan view illustrating the outline, which shows a flow of an electric current when the first feed element 10 is excited. Note that, in the embodiment of FIG. 1, the end parts 12 and 22 of the feed elements 10 and 20 and the first parallel parts 32 and 42 of the radiating elements 30 and 40 are respectively overlapped in the Z direction; however, for the explanation, the positions are shifted and described in FIG. 4. Furthermore, in FIG. 4, the first radiating element 30 and the second radiating element 40 are indicated to intersect each other; however, since the substrates 80 and 90 on which they are respectively arranged are different, they are not short-circuited.

In FIG. 4, the magnitude of the electric current is indicated by the thickness of the arrow. As indicated by outline arrows in the figure, by causing an electric current in a reverse direction (a cancellation electric current) to be generated in the second feed element so as to mutually cancel the electric currents regardless of the phase of the excited electric current, the electric current value in the second feed element is lowered.

For example, for the case of FIG. 4, an electric current flows in the direction of Ia in the first radiating element 30 by being excited by the first feed element 10. Furthermore, since the second parallel part 34 of the first radiating element 30 is extended longer than the end part 22 of the second feed element 20 along the ground plane 70 (which corresponds to the extending part 39), by causing an effect on the ground plane 70 by the electric current Ia in the first radiating element 30, an electric current Ia flows in the second feed element 20 through the ground plane 70. In the path created in this manner, the electric current Ia is distributed as a resonance current.

As a result that the first feed element 10 receives feeding of power at the feeding point 11 and is excited, an electric current Ib is generated in the ground plane 70 to be converged to the feeding point 11, and, further, the electric current Ib flows toward the second feed element 20 in the direction to converge. At this time, in the second radiating element 40, an electric current flows in the direction Ib by receiving an effect of a surrounding electromagnetic field, especially, an electromagnetic field generated by the electric current flowing in the first radiating element 30. Here, the electric current Ib that passes the second radiating element 40 and that flows in the second feed element 20, and the electric current Ib generated by the feeding point 11 in the ground plane 70 together form a path of the electric current. In the path generated in this manner, the electric current Ib is distributed as a resonance current.

In this manner, the resonance current is formed by another coupling path that is intentionally created, and by its functioning as a current to be cancelled in the second feed element 20 (cancellation electric current), the electric current value in the second feed element 20 is lowered.

Accordingly, regardless of the phase of the electric current, an unnecessary electric current is suppressed in the second feed element 20, and an isolation property can be enhanced. Consequently, the isolation property can be enhanced without arranging an additional parasitic element, so that implementability as an antenna device is enhanced.

Further, in FIG. 4, the example is illustrated where the first feed element 10 receives feeding of power from the feeding point 11, and is excited; however, the second feed element 20 may receive feeding of power from the feeding point 21, and may be excited. In this case, due to the symmetry of the structure, the resonance current formed by the other coupling path functions as the cancellation electric current in the first feed element 10, so that the isolation property can be enhanced.

<S11, S21 Characteristics>

Figure 5A:
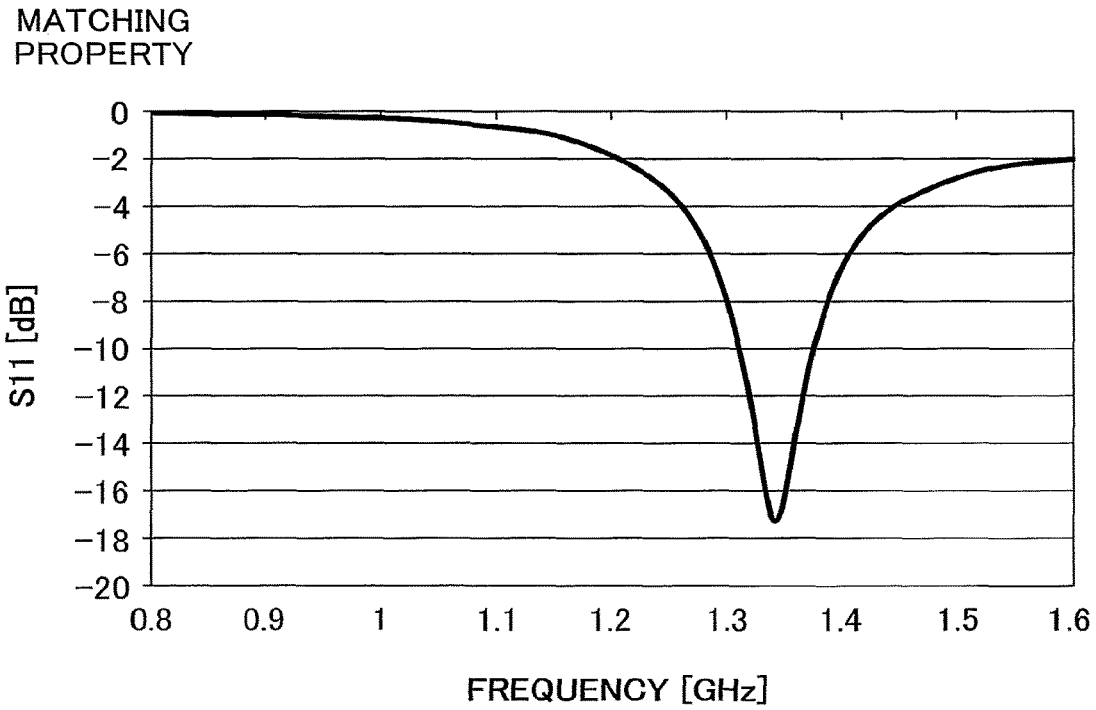
FIG. 5A is a diagram illustrating a matching property S11 of the antenna device of FIG. 1.

FIG. 5A shows the S11 characteristic of the antenna device 1 obtained in the simulation. Here, the S11 characteristic is one type of characteristics of a high frequency electronic component and so forth; and, in this specification, it is defined to be a matching characteristic represented by a return loss with respect to a frequency. Specifically, FIG. 5A shows a calculation result of the S11 characteristic when, in the configuration of the antenna device 1 of FIG. 1, gap feeding is performed at the feeding point 11 between the feeding point side edge 16 of the feed element 10 and the outer edge portion 71 of the ground plane 70. Here, the design frequency is 1.35 GHz.

Figure 5B:
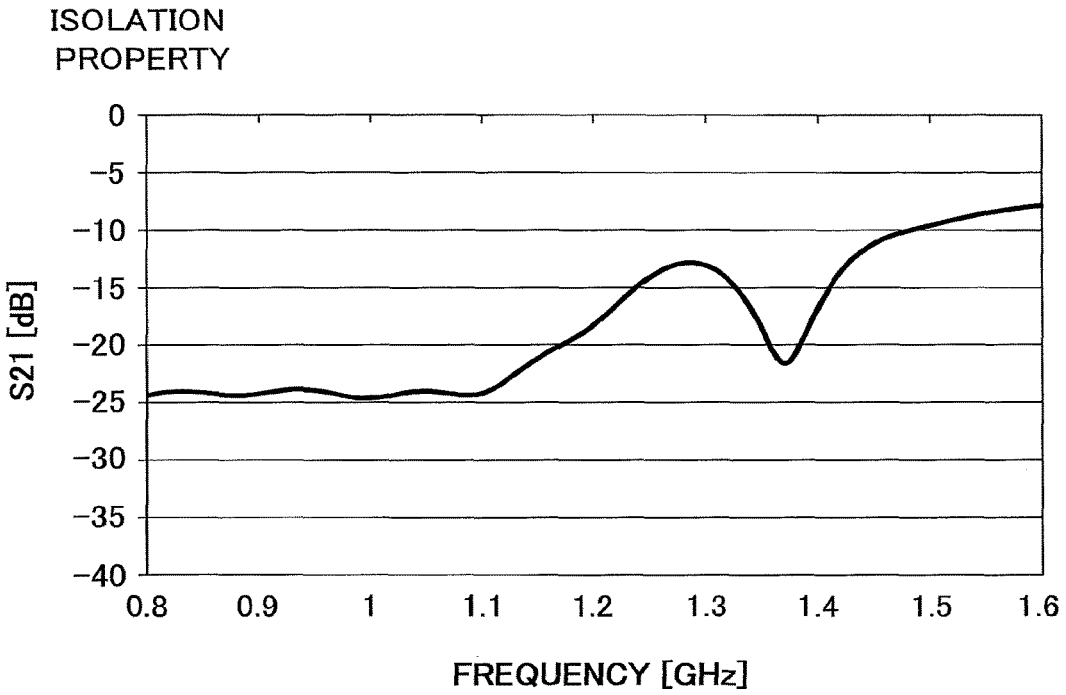
FIG. 5B is a diagram illustrating an isolation property S21 of the antenna device of FIG. 1.

FIG. 5B shows the isolation characteristic S21 obtained in the simulation. Here, the sizes of the parts illustrated in FIG. 1 through FIG. 3C under the simulation condition for analyzing FIG. 5A and FIG. 5B in units of mm are as follows:

the shortest distance between the feed element and the radiating element, and the ground plane L13: 5,
the length of the end part L12: 18,
the length of the second parallel part L34: 40,
the distance between the second parallel part and the ground plane L37: 10,
the conductor width of the feed element W10: 0.5,
the conductor width of the radiating element W30: 0.5,
the thickness of the feed element T10: 0.018,
the thickness of the radiating element T30: 0.018,
the lengths of the substrate and the ground plane in the Y direction L81: 120,
the length of the substrate in the X direction L82: 150,
the length of the ground plane in the Y direction L71: 70,
the distance between the feed elements 10 and 20 L83: 7,
the thickness of the ground plane T70: 0.0018, and
the thickness of the ground plane T80, T90: 0.8. The relative dielectric constant of the substrates 80 and 90, which are dielectrics, is 3.3, and tan $\delta$=0.003. Note that the feed element 20 and the feed element 10 are synmmetrical and have the same sizes; and the radiating element 40 and the radiating element 30 are symmetrical and have the same sizes.

In FIG. 5A, the point at which the matching characteristic S11 becomes the minimum value is the impedance matching frequency, at which impedance matching is achieved; and this value is the operating frequency. Furthermore, in FIG. 5B, the point at which the value of S21 locally decreases and becomes the minimum is an isolation local minimum frequency; and high isolation is achieved at this frequency.

In the configuration of the present invention, as illustrated in FIG. 4, as a result that the cancellation electric current is generated in the second feed element, isolation in the vicinity of the operating frequency is enhanced. Consequently, in the vicinity of the operating frequency at which the minimum value is obtained in FIG. 5A, the isolation frequency S21 illustrated in FIG. 5B takes almost the minimum value. Namely, the impedance matching frequency almost matches the isolation local minimum frequency.

Second Embodiment

It is possible, for the above-described antenna, that the antenna characteristics are varied because of the influence of the surrounding environment of a terminal (a radio apparatus), in which the antenna is installed. In particular, for a case where the antenna characteristics are shifted due to movement of the position of the installed terminal and changes in the environment of shields in the surrounding, a variable impedance unit may further be included, so that tuning for compensating for the shifted amount can be performed.

In the embodiment, by providing the variable impedance unit, stepwise tuning can be performed.

Figure 6A:
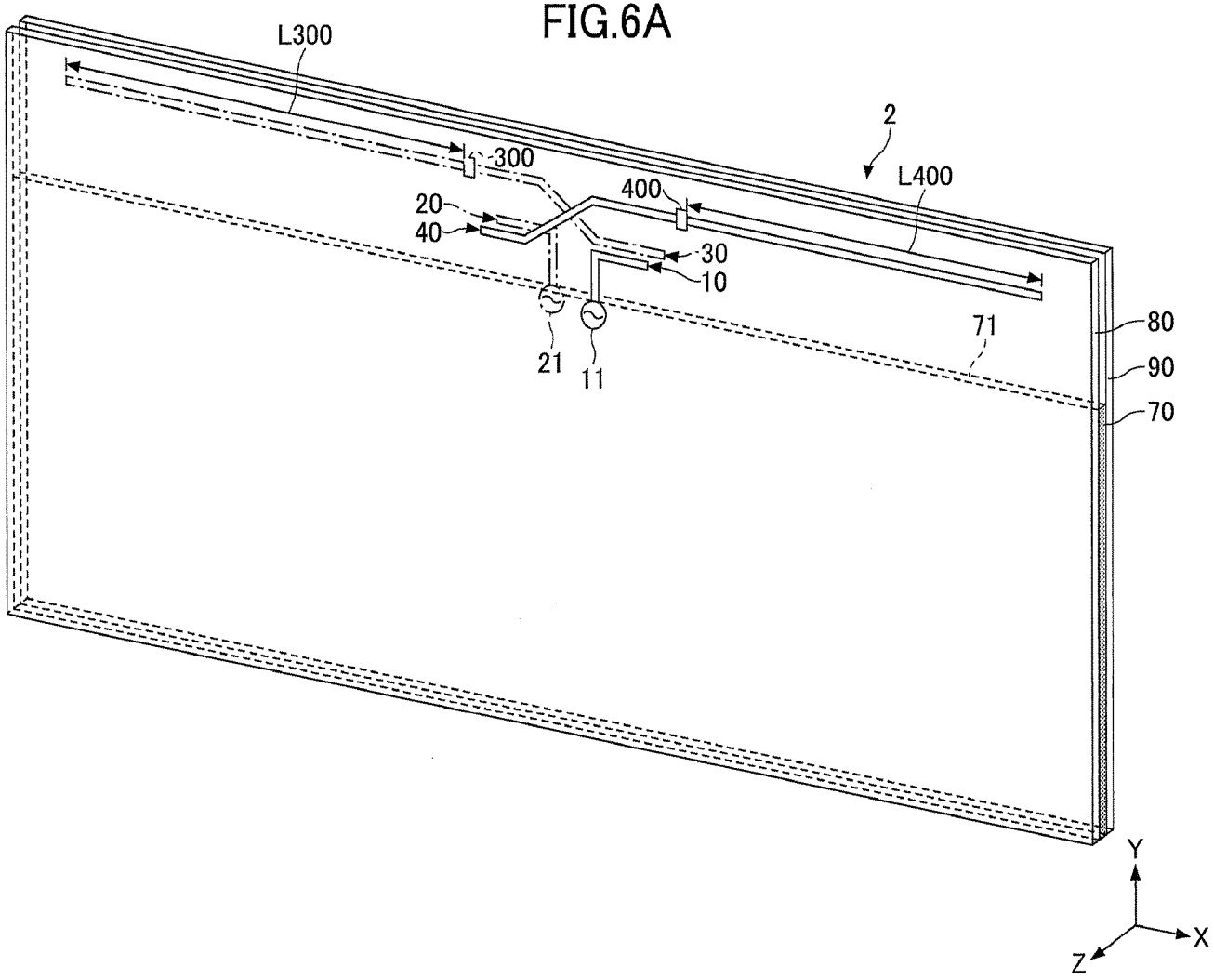
FIG. 6A is a perspective view illustrating an example of an analysis model of an antenna device according to another embodiment of the present invention.

FIG. 6A is a perspective view illustrating a simulation model on a computer for analyzing operation of an antenna device 2 according to a second embodiment of the present invention. As an electromagnetic field simulator, Microwave Studio (registered trademark) (CST Computer Simulation Technology AG) was used.

Figure 6B:
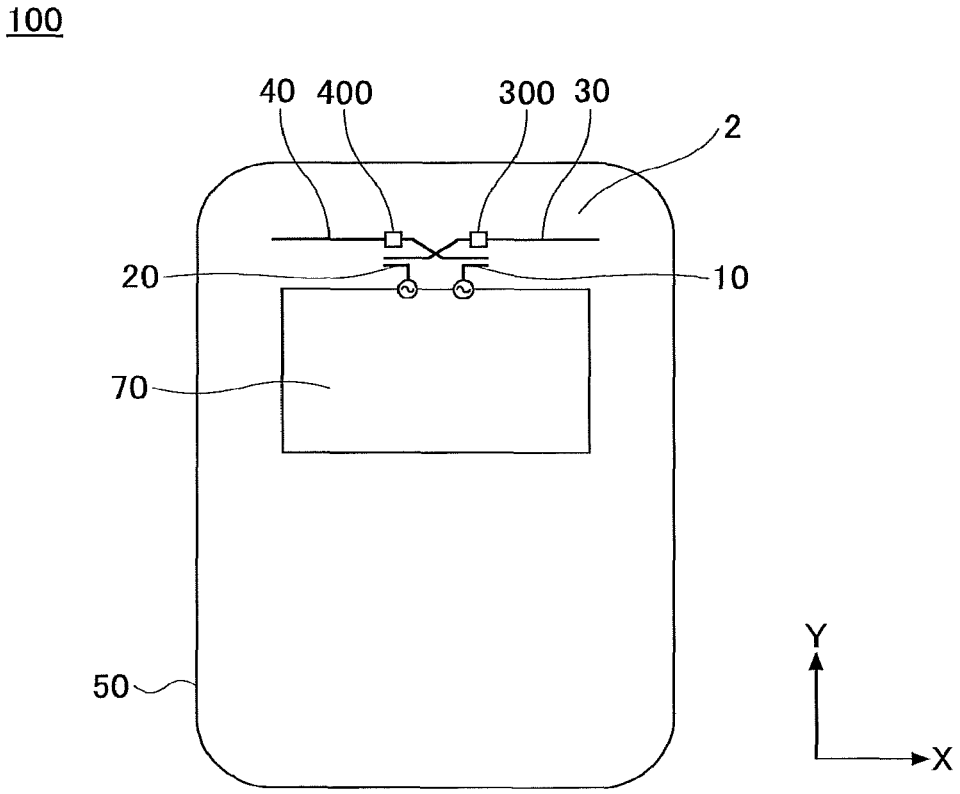
FIG. 6B is a plan view where the antenna device illustrated in FIG. 6A is implemented in a radio apparatus.

The antenna device 2 may be implemented in a case 50 of a radio apparatus (a radio communication device) 100. FIG. 6B is a plan view of the radio apparatus 100, and it is a perspective diagram, so that arrangement positions of the components of the antenna device 2, such as the feed elements 10 and 20, the radiating elements 30 and 40, and the ground plane 70 can be easily visualized.

The radio apparatus 100 is a radio apparatus that can be carried by a person. As specific examples of the radio apparatus 100, there are electronic devices, such as an information terminal, a mobile phone, a smartphone, a personal computer, a game device, a TV, music and video players. Note that an antenna device according to another embodiment may also be implemented in the radio apparatus.

The difference between the antenna device 2 of this embodiment and the antenna device 1 of FIG. 1 is that, in this embodiment, the radiating elements 30 and 40 are further provided with variable impedance units 300 and 400, respectively. The variable impedance units 300 and 400 are, for example, inductors, capacitors, or variable capacitance diodes. The variable impedance unit may switch in a binary manner by on/off of a switch; or may continuously vary the impedance.

The variable impedance units 300 and 400, which are provided in this manner, directly control impedance values by an external signal input to the antenna device 2. Alternatively, the antenna device 2 may include, for example, a matching circuit for adjusting the resonance frequencies of the fundamental modes of the radiating element 30 and radiating element 40 by controlling the variable impedance units 300 and 400, respectively; and the resonance frequencies may be adjusted, in connection with that the coupling states are varied.

Figure 7A:
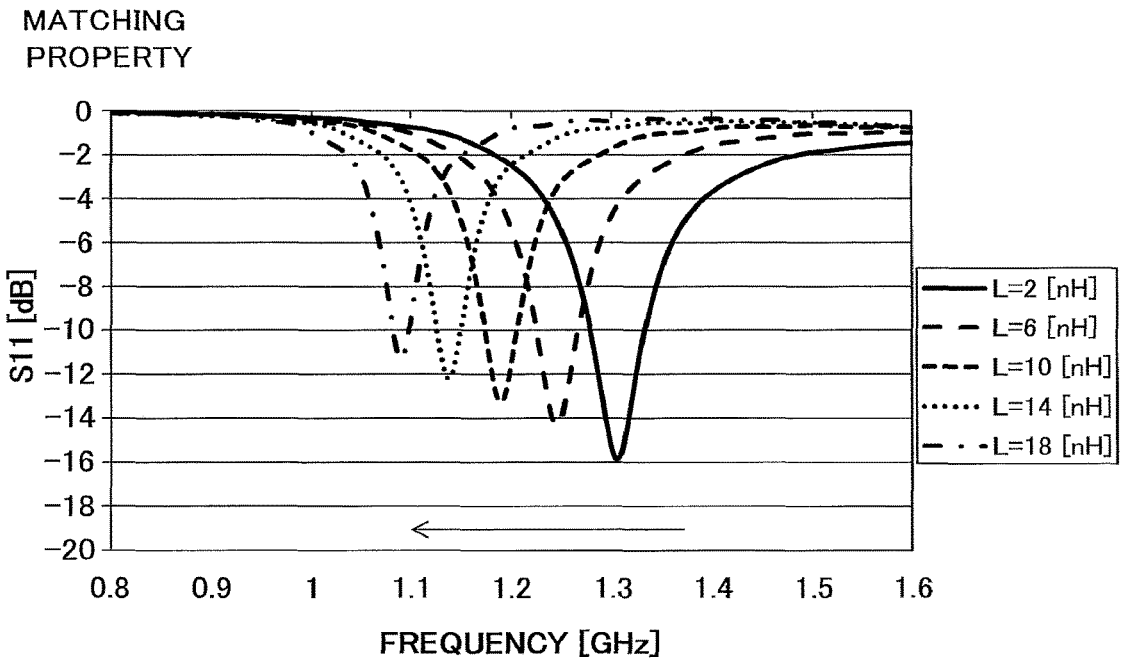
FIG. 7A is a diagram illustrating a matching property S11 of the antenna device of FIG. 6A.
Figure 7B:
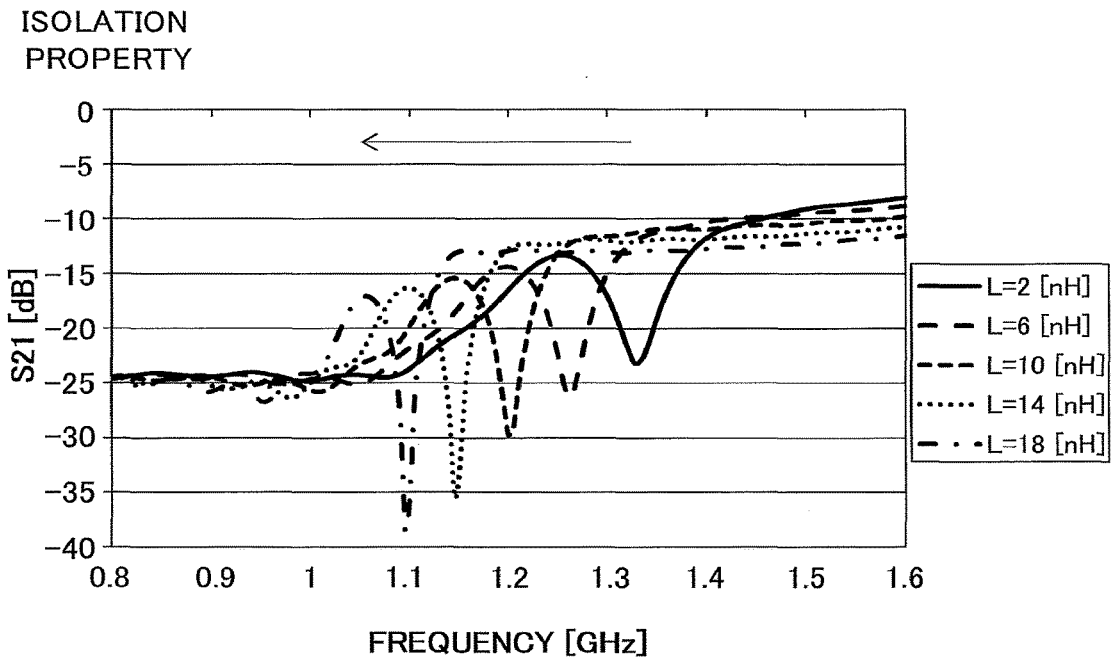
FIG. 7B is a diagram illustrating an isolation property S21 of the antenna device of FIG. 6A.

FIGS. 7A and 7B are S11 characteristic diagrams where stepwise tuning is performed by providing the variable impedance units 300 and 400, as in FIG. 6A.

As examples, graphs are shown where simulation was performed while varying the inductor values of the variable impedance units 300 and 400, which are inserted into the radiating elements 30 and 40 in series, respectively, as in FIG. 6A. The sizes under the measurement condition of FIGS. 7A and 7B are as follows: in addition to the conditions of FIG. 5A and FIG. 5B, the positions to install the variable impedance units 300 and 400 in units of mm are:
the distance from the edge to the variable inductor L300, L400: 29.5.

In the simulation of FIG. 7, the inductor of the variable impedance unit was varied.

In this embodiment, similar to the above-described embodiment, as in FIG. 4, by generating the electric current to be cancelled (the cancellation electric current) in the second feed element 20 by the other coupling path which is intentionally created, the electric current value is lowered. Accordingly, isolation of the entire antenna is enhanced. Consequently, isolation of the entire antenna is enhanced without arranging an additional parasitic element. Namely, as a result that the cancellation electric current is generated in the feed element, isolation in the vicinity of the operating frequency is enhanced.

Furthermore, in this embodiment, when the impedance matching frequency is controlled by controlling the inductor values by the variable impedance units, a similar cancellation electric current is generated, so that the isolation local minimum frequency can also be controlled. Consequently, in the vicinity of the operating frequency where S11 is the minimum value, for these inductor values, corresponding S21 takes the minimum value. Namely, the impedance matching frequency almost matches the isolation local minimum frequency. Note that the isolation local minimum frequency is the point where the value is small compared to the surrounding, and the difference due to magnitude of the value is not considered here.

Furthermore, by the variable impedance units, both the impedance matching frequency and the isolation local minimum frequency are controlled. As it can be seen from the graphs of FIG. 7A and FIG. 7B, even for a case where the impedance matching frequency (the operating frequency) is adjusted and varied, isolation in the vicinity of the operating frequency is enhanced, as a result that the cancellation electric current is generated in the feed element, so that the impedance matching frequency almost matches the isolation local minimum frequency.

Accordingly, in FIG. 7B, as the impedance matching frequency is varied by the variable impedance units (cf. FIG. 7A), the isolation local minimum frequency is controlled so that it varies while being almost matched.

Consequently, multistage tuning can be performed for the impedance matching frequency and the isolation local minimum frequency. By using such control of the frequency, the frequency characteristics can be varied, and adaptation to the changing environment of the peripheral devices of the terminal can be achieved.

Third Embodiment

In the above-described first embodiment and second embodiment, the feed element and the radiating element are arranged so that they overlap in the YZ direction. However, for the present invention, the example of the configuration for generating the cancellation electric current, such as that of illustrated in FIG. 4, is not limited to this configuration; and it can be another configuration.

Figure 8:
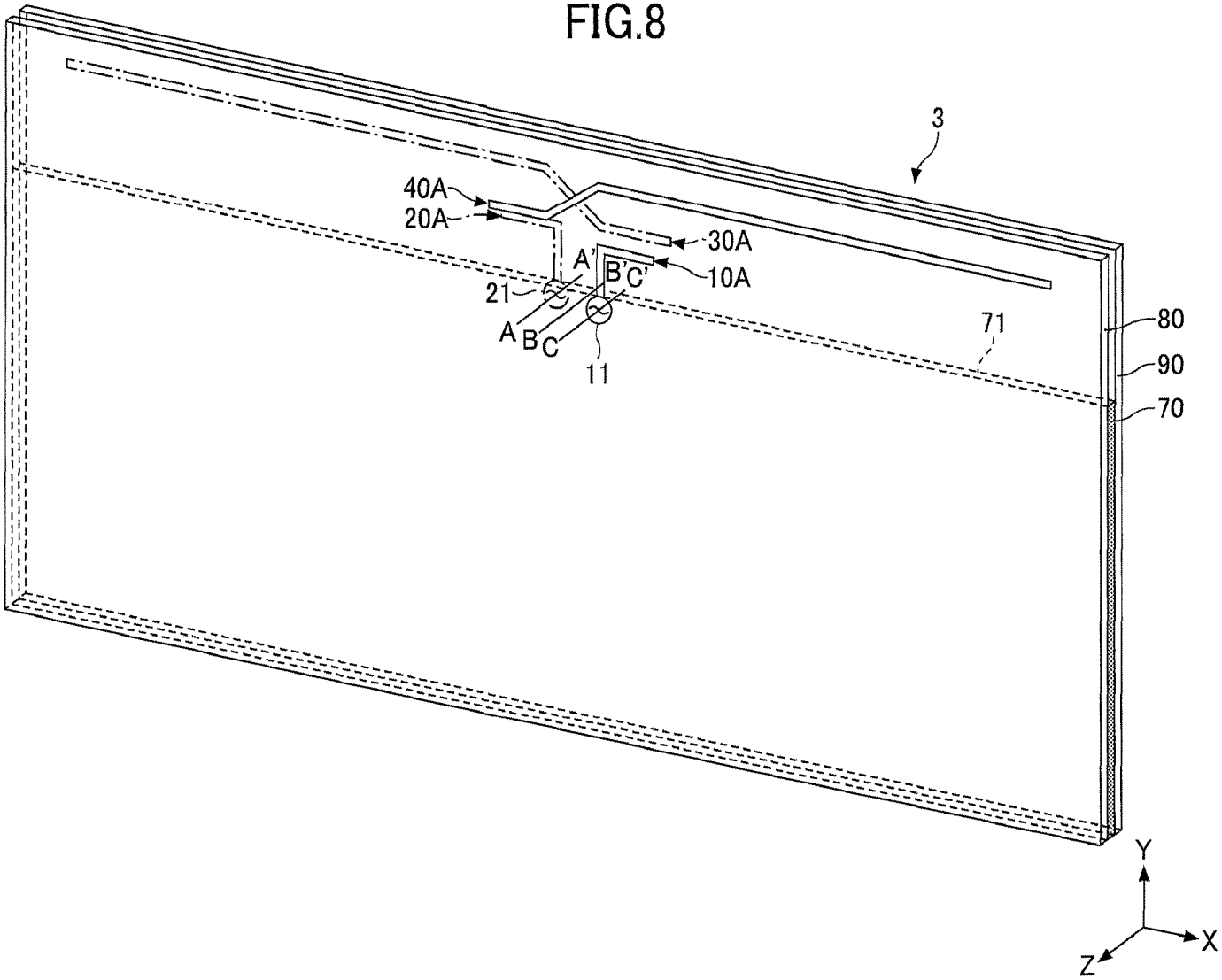
FIG. 8 is a perspective view illustrating an example of an analysis model of an antenna device according to another embodiment of the present invention.
Figure 9A:
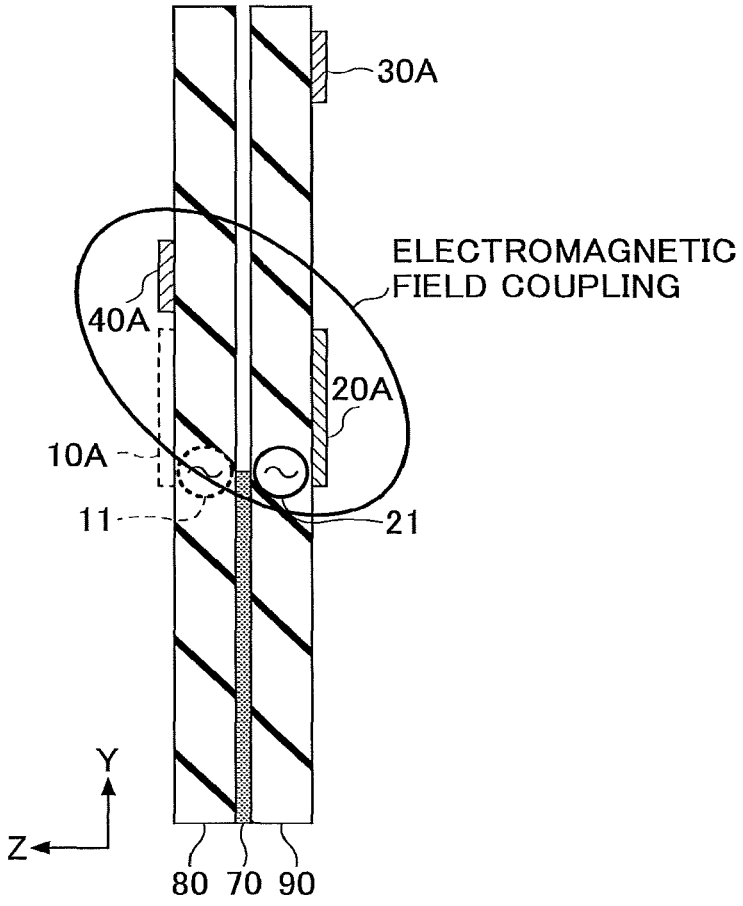
FIG. 9A is a cross-sectional view along A-A' in a YZ direction of the antenna device of FIG. 8.
Figure 9B:
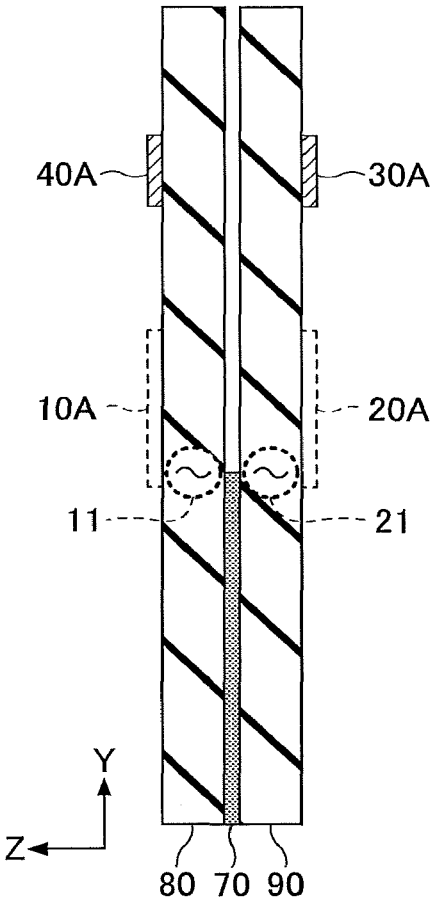
FIG. 9B is a cross-sectional view along B-B' in the YZ direction of the antenna device of FIG. 8.
Figure 9C:
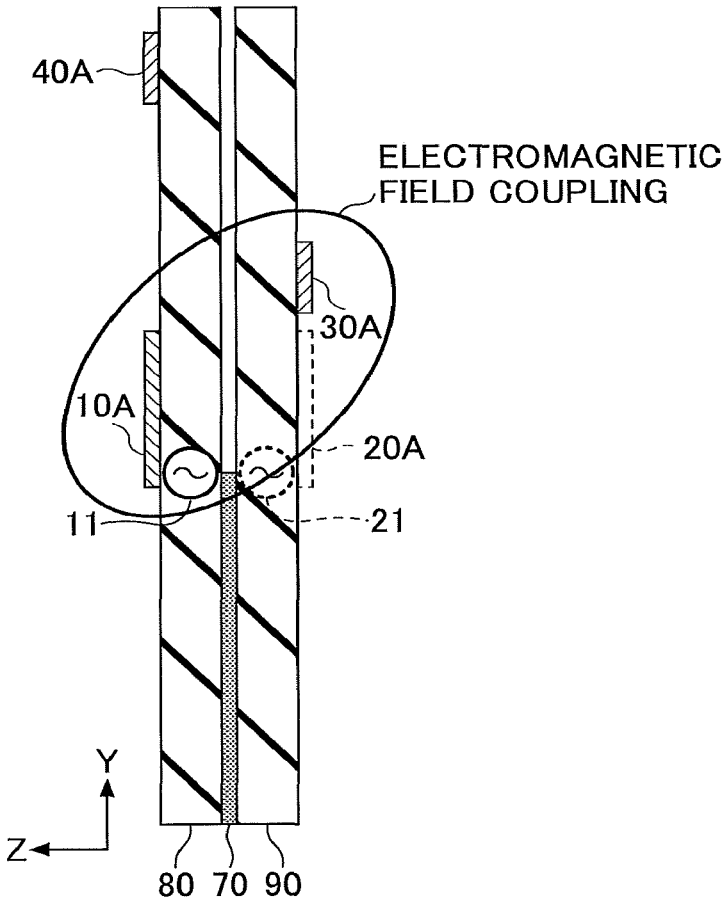
FIG. 9C is a cross-sectional view along C-C' in the YZ direction of the antenna device of FIG. 8.

FIG. 8 is a perspective view illustrating a simulation model on a computer for analyzing operation of an antenna device 3 according to a third embodiment of the present invention. FIGS. 9A through 9C are cross sectional views in the YZ direction of the antenna of FIG. 8.

In this embodiment, the configuration is the same as that of the above-described embodiment, except for the point that the feed element and the radiating element are not located at the same positions in the Z direction. In this embodiment, in the cross section along A-A', as illustrated in FIG. 9A, electromagnetic field coupling is established between the second feed element 20A and the second radiating element 40A at positions that are slightly shifted in the Z direction. Similarly, in the cross section along C-C', as illustrated in FIG. 9C, electromagnetic field coupling is established between the first feed element 10A and the first radiating element 30A at positions that are slightly shifted in the Z direction.

In such a configuration, the radiation part of the first radiating element 10A includes a part that extends in a position that is in the vicinity of the second feed element 20A and that is separated from the ground plane 70 compared to the second feed element 20A. Additionally, the part of the first radiating element 30A that extends in the vicinity of the second feed element 20A extends along the outer edge portion 71 of the ground plane 70 in the part where the second feed element 20A is not located, i.e., the side opposite to the part where electromagnetic field coupling is established.

As illustrated in FIG. 4, by generating, by the extended part of the first radiating element 30A and an electromagnetic field caused by the excited first feed element 10A, the electric current to be cancelled (the cancellation electric current) in the second feed element 20 by the other coupling path which is intentionally created, the electric current value is lowered. Thus, as a result that the cancellation electric current is generated in the feed element, isolation in the vicinity of the operating frequency is enhanced without arranging an additional parasitic element; and the impedance matching frequency almost matches the isolation local minimum frequency.

Fourth Embodiment

Figure 10:
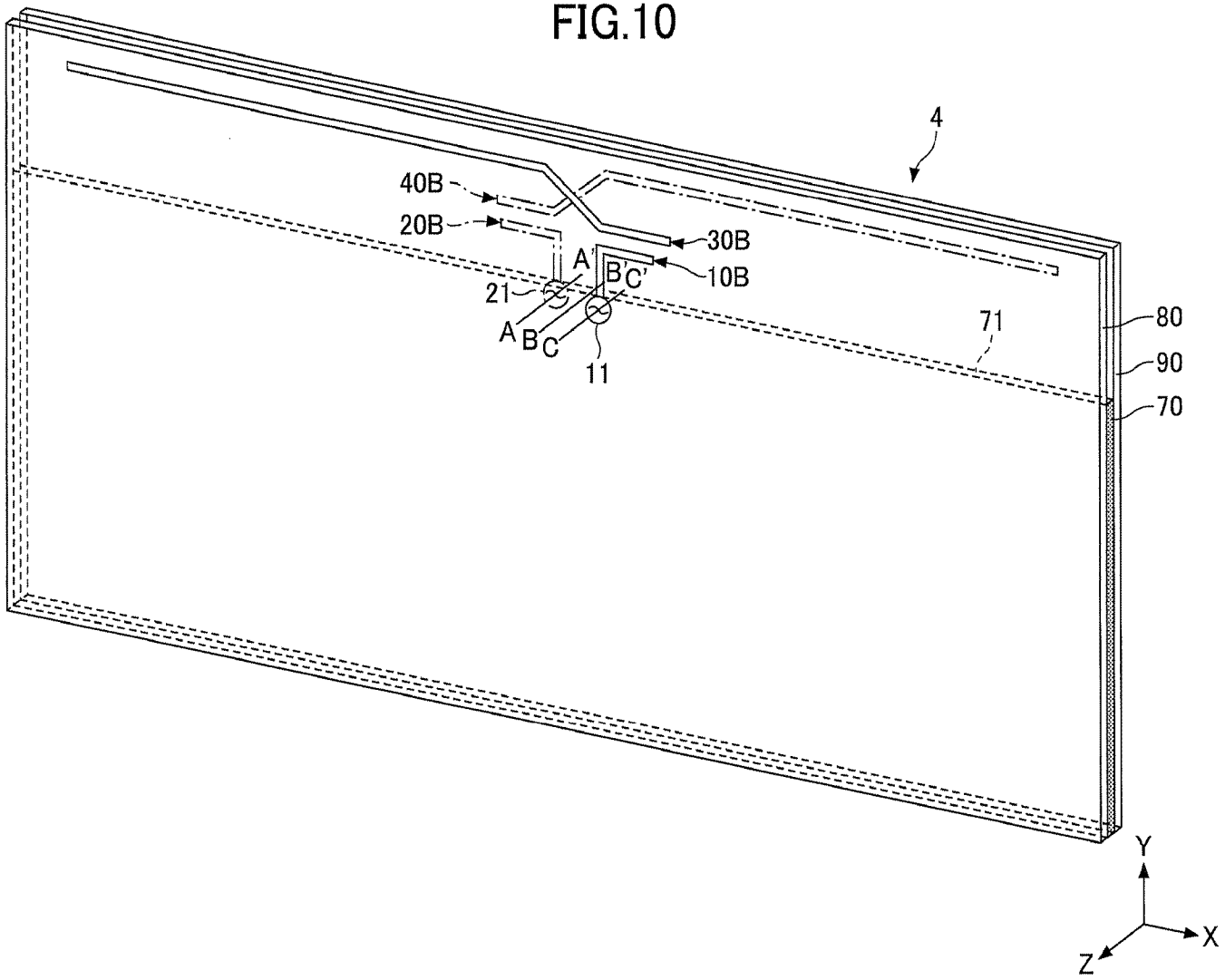
FIG. 10 is a perspective view illustrating an example of an analysis model of an antenna device according to yet another embodiment of the present invention.
Figure 11A:
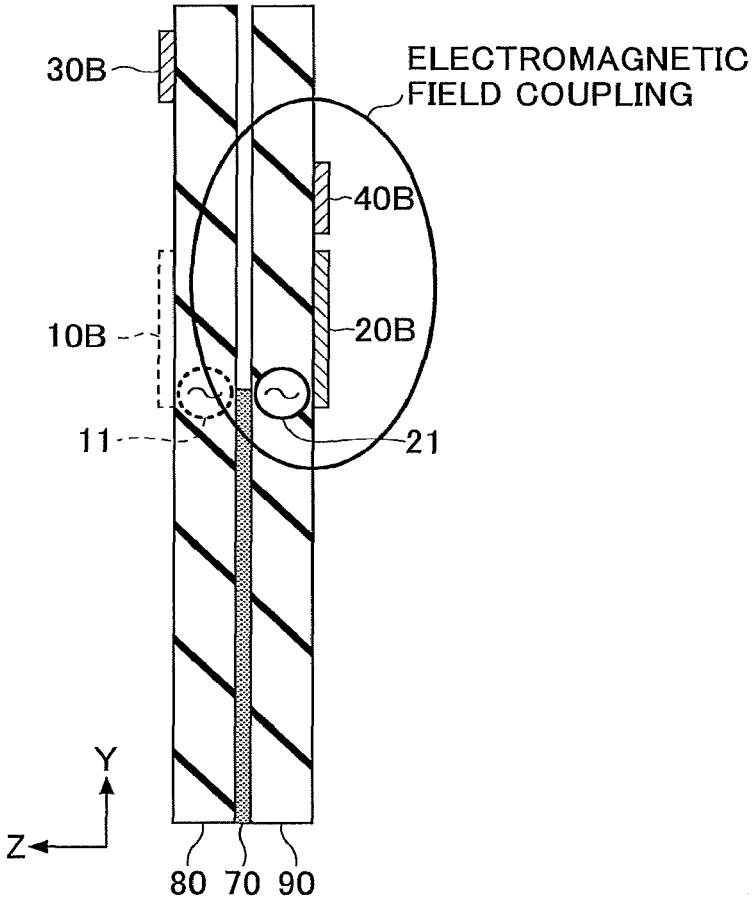
FIG. 11A is a cross-sectional view along A-A' in a YZ direction of the antenna device of FIG. 10.
Figure 11B:
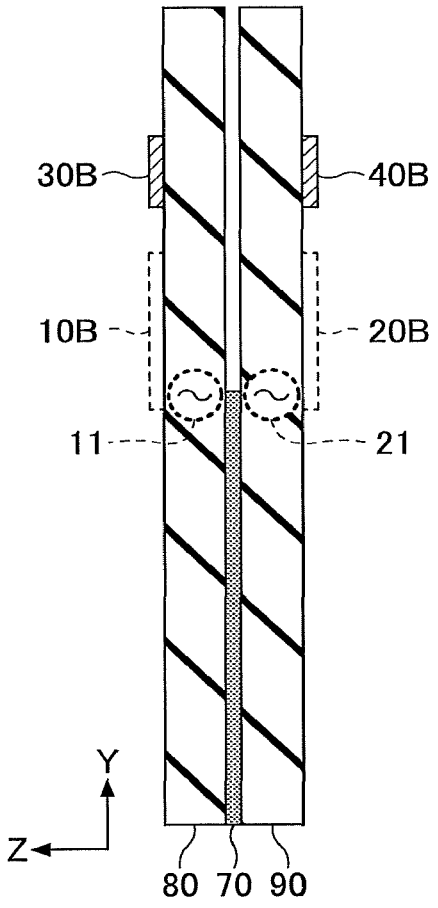
FIG. 11B is a cross-sectional view along B-B' in the YZ direction of the antenna device of FIG. 10.
Figure 11C:
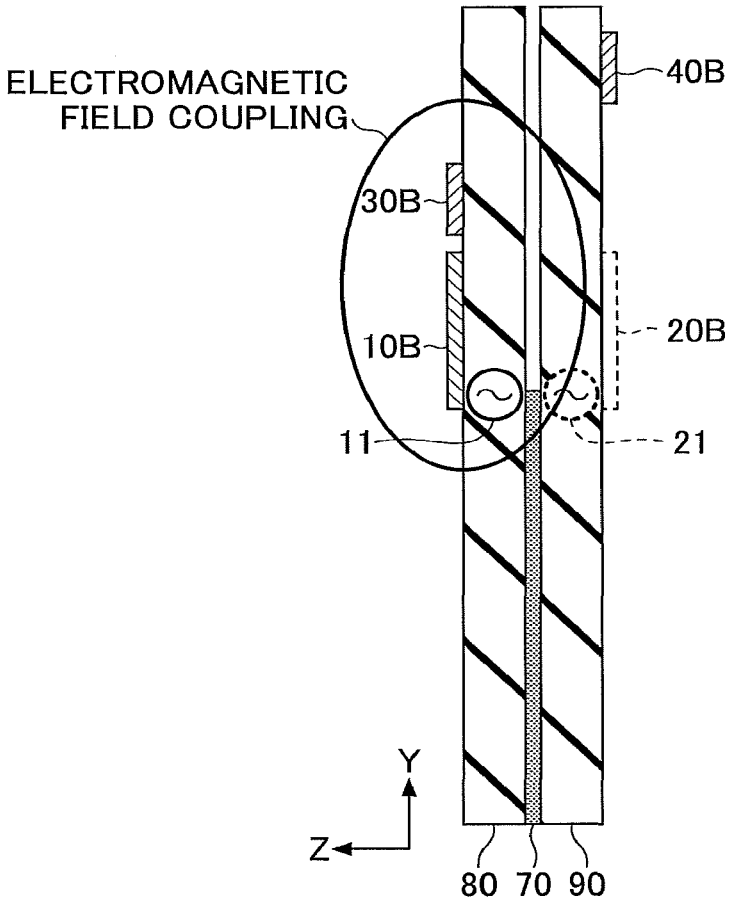
FIG. 11C is a cross-sectional view along C-C' in the YZ direction of the antenna device of FIG. 10.
Figure 12A:
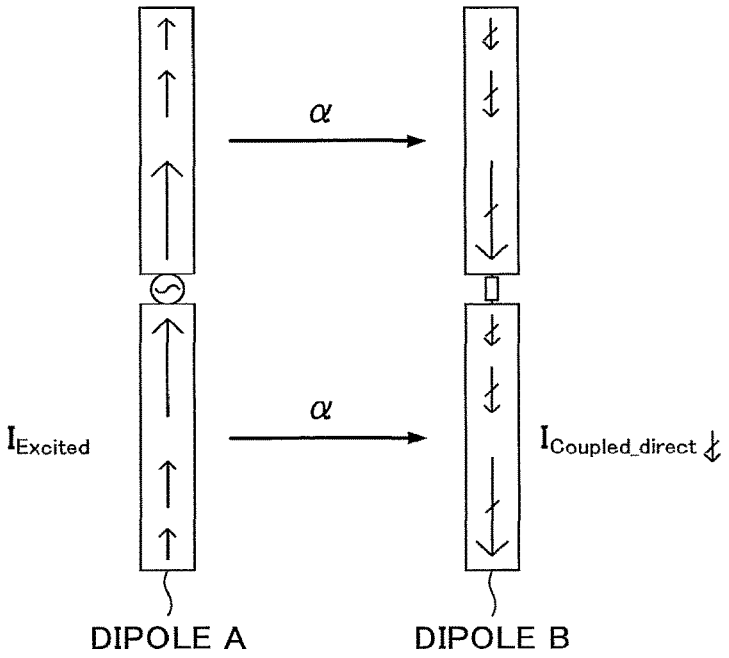
FIG. 12A is a plan view of an example of an antenna device according to related art.
Figure 12B:
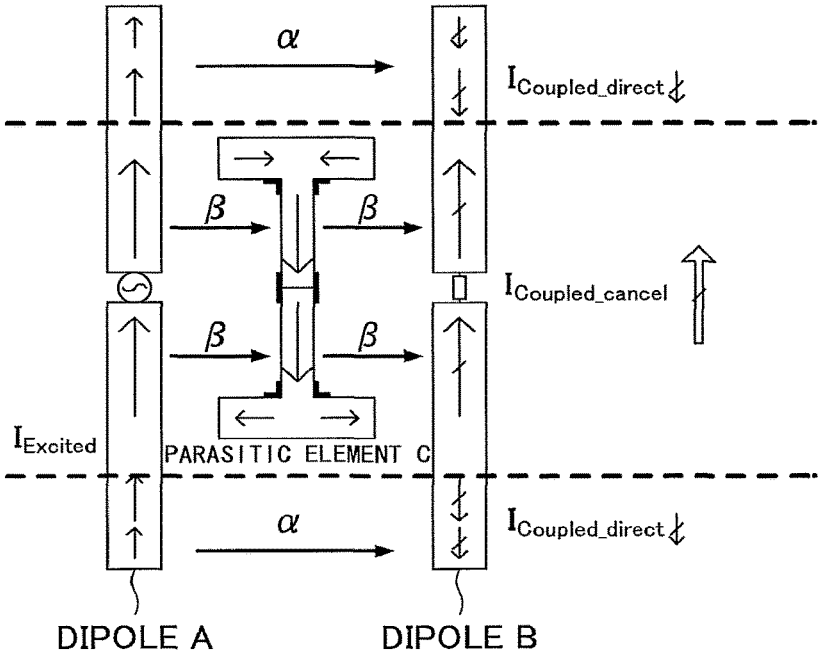
FIG. 12B is a plan view of an example of an antenna device according to an example 1 of related art.
Figure 13:
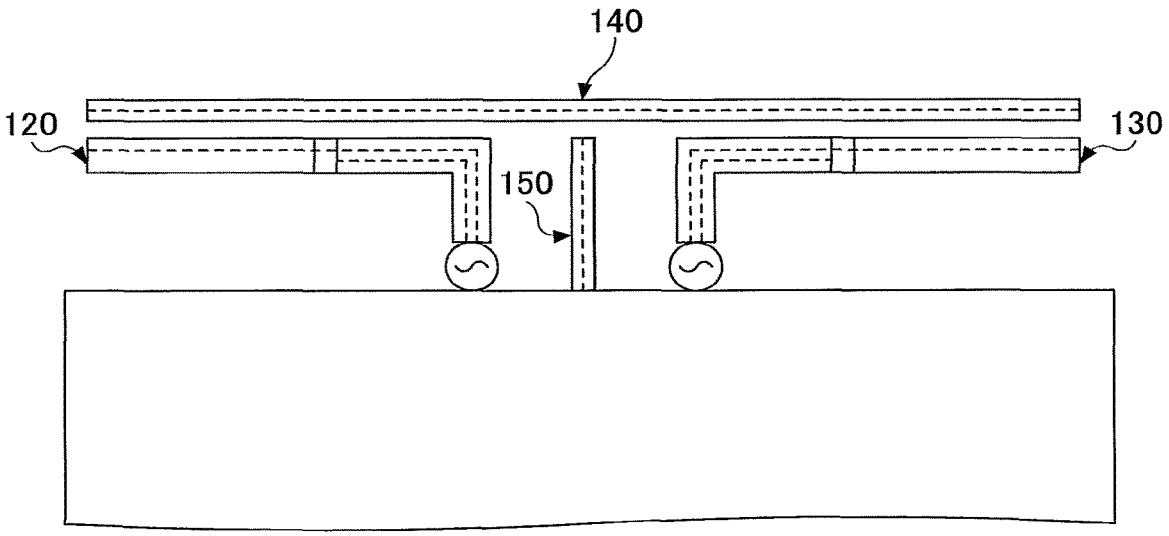
FIG. 13 is a plane view of an example of an antenna device according to an example 2 of related art.
Figure 14:
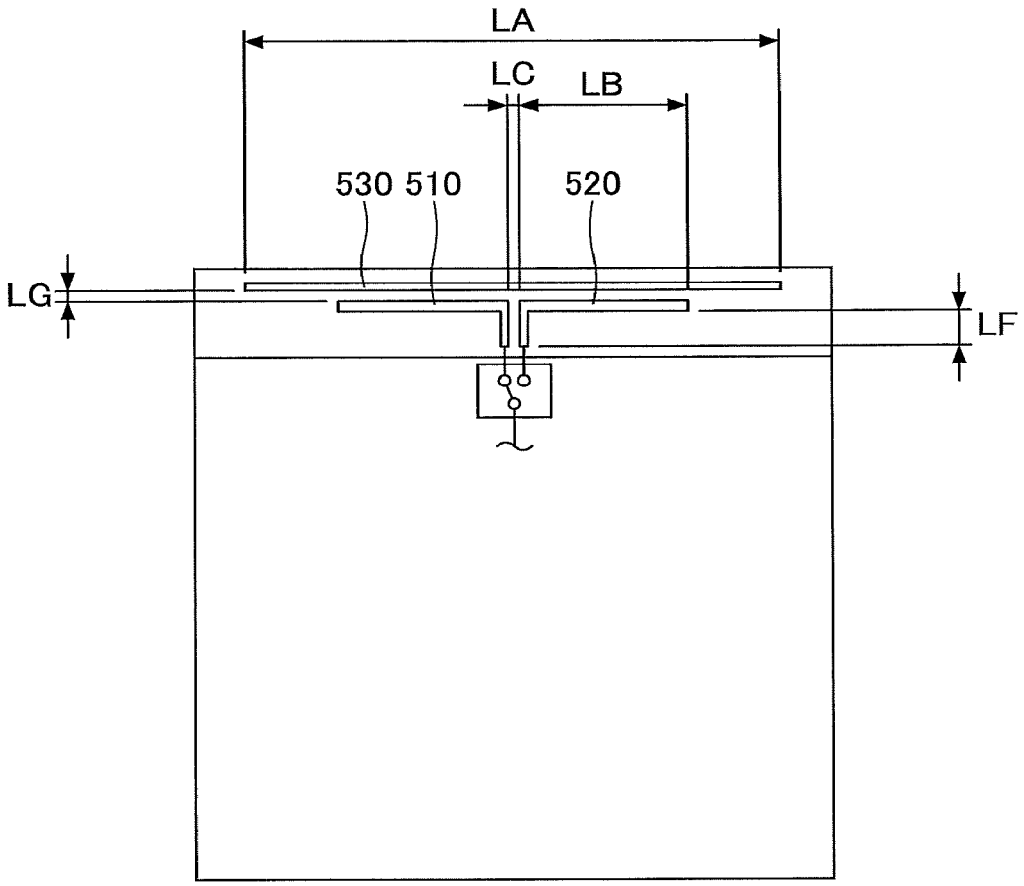
FIG. 14 is a plan view of an example of an antenna device according to an example 3 of related art.

FIG. 10 is a perspective view illustrating a simulation model on a computer for analyzing operation of an antenna device 4 according to a fourth embodiment of the present invention. FIGS. 11A through 11C are cross sectional views in the Z direction of the antenna of FIG. 10.

In this embodiment, the first feed element 10B and the first radiating element 30B are located on a same substrate; and the second feed element 20B and the second radiating element 40B are located on a same substrate. The sizes other than the substrates are the same as those of the configuration of FIG. 1, so that the description is omitted.

In this embodiment, in the cross section along A-A', as illustrated in FIG. 11A, electromagnetic field coupling is established between the second feed element 20 B and the second radiating element 40B at positions on the same substrate that are separated in the X direction by a predetermined distance. Similarly, in the cross section along C-C', as illustrated in FIG. 11C, electromagnetic field coupling is established between the first feed element 10B and the first radiating element 30B at positions on the same substrate that are separated in the X direction.

In such a configuration, the radiation part of the first radiating element 30B includes a part that extends in a position that is in the vicinity of the second feed element 20B and that is separated from the ground plane 70 compared to the second feed element 20B. Additionally, the part of the first radiating element 30B that extends in the vicinity of the second feed element 20B extends along the outer edge portion 71 of the ground plane 70 in the part where the second feed element 20B is not located, i.e., the side opposite to the part where electromagnetic field coupling is established.

As illustrated in FIG. 4, by generating, by the extended part of the first radiating element 30B and an electromagnetic field caused by the excited first feed element 10A, the electric current to be cancelled (the cancellation electric current) in the second feed element 20 by the other coupling path which is intentionally created, the electric current value is lowered. Thus, as a result that the cancellation electric current is generated in the feed element, isolation in the vicinity of the operating frequency is enhanced without arranging an additional parasitic element; and the impedance matching frequency almost matches the isolation local minimum frequency.

In the above-described first embodiment through the fourth embodiment, the closest parts of the first and second feed elements and radiating elements intersect in parallel. However, the parts where electromagnetic field coupling is to be established may not be parallel. A variation of the embodiment of the antenna device may be such that the intersection angle between the feed element 10 and the radiating element 30 differs from that of the feed element 20 and the radiating element 40. Regardless of which angles the feed elements 10 and 20 intersect the radiating elements 30 and 40, respectively, a desired value can be maintained for the operation gain of each of the radiating elements 30 and 40, as long as electromagnetic field coupling is established between corresponding elements. Furthermore, even if the intersection angles are varied, there is almost no effect on the characteristics of the operation gain of the radiating elements 30 and 40.

Note that, in order to generate the cancellation electric current, for example, in the example of the configuration where the first feed element 10B and the first radiating element 30B, and the second feed element 20B and the second radiating element 40B are located on the corresponding same substrates, as in the fourth embodiment, though the feed element and the radiating element are in proximity in the horizontal direction, these are arranged not to contact/intersect, and these are prevented from being short-circuited.

In the above-described embodiment, two radiating elements are arranged. However, in the present invention, the example of the configuration for generating the cancellation electric current, such as illustrated in FIG. 4, is not limited to this configuration, and it can be another configuration. For example, there may be a single radiating element.

The antenna is described by the embodiments above; however, the present invention is not limited to the above-described embodiments. Various modification and improvements, such as combinations and replacement of a part or all of other embodiments, can be made within the scope of the present invention. Note that the sizes, the positional relationship, and so forth of the components illustrated in each drawing may be exaggerated for clarifying the description.

For example, the antenna is not limited to the depicted configurations. For example, the antenna may include a conductor part directly connected to or indirectly connected, through a connecting conductor, to the radiating element; or may include a conductor part that is coupled to the radiating element in a high frequency manner (e.g., capacitive).

Furthermore, the feed element and the radiating element are not limited to the linear conductors that extend linearly; and may include curved conductor parts. For example, it may include an L-shaped conductor part; may include a meander shaped conductor part; or may include a conductor part that branches in the middle.

Furthermore, the transmission line provided with the ground plane is not limited to the microstrip line. For example, there are a strip line; a coplanar waveguide with a ground plane (coplanar waveguide with a ground plane that is located on the surface opposite to the conductor surface), and so forth.

Furthermore, the ground plane is not limited to the depicted outer shape; and it may be a conductor pattern having another outer shape. Furthermore, the ground plane is not limited to the configuration where it is formed to be flat; and it may be a configuration where it is formed to be a curved shape. Similarly, a plate-shaped conductor is not limited to the depicted outer shape; and it can be a conductor having another outer shape. Furthermore, the plate-shaped conductor is not limited to the configuration where it is formed to be flat; and it may be a configuration where it is formed to be a curved shape.

Furthermore, "plate-shaped" may include meaning of "foil-shaped" or "film-shaped." The multi-antenna is described by the embodiments and the example above; however, the present invention is not limited to the above-described embodiments and the examples. Various modification and improvements, such as combinations and replacement of a part or all of other embodiments, can be made within the scope of the present invention.

What is claimed is:

1. A multi-antenna, comprising:

a ground plane;

a first antenna structure comprising a first feeding point positioned on a first surface of the ground plane, a first feed element connected to the first feeding point, and a first radiating element positioned to establish electromagnetic field coupling with the first feed element such that the first radiating element functions as a radiation conductor when power is supplied by the first feed element through the electromagnetic field coupling with the first feed element; and a second antenna structure comprising a second feeding point positioned on a second surface of the ground plane, a second feed element connected to the second feeding point, and a second radiating element positioned to establish electromagnetic field coupling with the second feed element such that the second radiating element functions as a radiation conductor when power is supplied by the second feed element through the electromagnetic field coupling with the second feed element, wherein the first radiating element of the first antenna structure and the second radiating element of the second antenna structure are positioned on mutually different planes such that the first and second radiating elements intersect with respect to each other and that no ground conductive line is formed between the first and second radiating elements.

2. The multi-antenna according to claim 1, wherein the first radiating element includes a part that extends in a vicinity of the second feeding point and that extends along an edge portion of the ground plane, and the second radiating element includes a part that extends in a vicinity of the first feeding point and that extends along the edge portion of the ground plane.

3. The multi-antenna according to claim 2, wherein, when electrical lengths for providing a fundamental mode of resonance of the first and second feed elements are Le10 and Le20, electrical lengths for providing a fundamental mode of resonance of the first and second radiating elements are Le30 and Le40, and a wavelength on the first and second feed elements or the first and second radiating elements at a resonance frequency of the fundamental mode of the first and second radiating elements is $\lambda$, the Le10 and Le20 are less than or equal to $(3/8)\cdot\pi$, and the Le30 and Le40 are greater than or equal to $(3/8)\cdot\lambda$ and less than or equal to $(5/8)\cdot\lambda$.

4. The multi-antenna according claim 2, further comprising:

a variable impedance unit comprising circuitry configured to control an isolation local minimum frequency.

5. The multi-antenna according to claim 4, wherein the circuitry of the variable impedance unit is configured to control an impedance matching frequency and the isolation local minimum frequency.

6. The multi-antenna according to claim 2, further comprising:

a feed circuit; and a switch element that is connected to the first feeding point, the second feeding point, and the feed circuit such that the switch element is configured to alternatively switch supply of power to the first feed element and supply of power to the second feed element.

7. The multi-antenna according to claim 1, wherein, when electrical lengths for providing a fundamental mode of resonance of the first and second feed elements are Le10 and Le20, electrical lengths for providing a fundamental mode of resonance of the first and second radiating elements are Le30 and Le40, and a wavelength on the first and second feed elements or the first and second radiating elements at a resonance frequency of the fundamental mode of the first and second radiating elements is $\lambda$, the Le10 and Le20 are less than or equal to $(3/8)\cdot\lambda$, and the Le30 and Le40 are greater than or equal to $(3/8)\cdot\lambda$ and less than or equal to $(5/8)\cdot\lambda$.

8. The multi-antenna according claim 1, further comprising:

a variable impedance unit comprising circuitry configured to control an isolation local minimum frequency.

9. The multi-antenna according to claim 8, wherein the circuitry of the variable impedance unit is configured to control an impedance matching frequency and the isolation local minimum frequency.

10. The multi-antenna according to claim 9, wherein the circuitry of the variable impedance unit is configured to control the impedance matching frequency and the isolation local minimum frequency such that the impedance matching frequency almost matches the isolation local minimum frequency.

11. The multi-antenna according to claim 1, further comprising:

a feed circuit; and a switch element that is connected to the first feeding point, the second feeding point, and the feed circuit such that the switch element is configured to alternatively switch supply of power to the first feed element and supply of power to the second feed element.

12. The multi-antenna according to claim 1, wherein, when a wavelength in vacuum at a resonance frequency of a fundamental mode of each of the radiating elements is $\lambda_0$, a shortest distance between the corresponding feed element and the radiating element is less than or equal to $0.2\times\lambda_0$.

13. The multi-antenna according to claim 1, wherein each of the first and second radiating elements includes a feeding part that receives supply of power from a respective one of the first and second feed elements, and the feeding part is a portion of each of the first and second radiating elements other than a central part of the respective one of the first and second radiating element.

14. The multi-antenna according to claim 1, wherein each of the first and second radiating elements includes a feeding part that receives supply of power from a respective one of the first and second feed elements, and the feeding part is a portion of each of the first and second radiating elements that is separated from a central part of the respective one of the first and second radiating elements by a distance that is greater than or equal to 1/8 a total length of the respective one of the first and second radiating elements.

15. The multi-antenna according to claim 1, wherein a distance within which each of the first and second feed elements and a respective one of the first and second radiating elements are extended while separated by a shortest distance is less than or equal to 3/8 a length of the respective one of the first and second radiating elements.

16. The multi-antenna according to claim 1, wherein each of the first and second radiating elements includes a feeding part that receives supply of power from a respective one of the first and second feed elements, and when a wavelength in vacuum at a resonance frequency of a fundamental mode of the first and second radiating elements is $\lambda_0$, a shortest distance between the feeding part and the ground plane is greater than or equal to $0.0034\lambda_0$ and less than or equal to $0.21\lambda_0$.

17. The multi-antenna according to claim 1, wherein the first and second antenna structures are configured such that a resonance frequency of the first radiating element and the second radiating element is different from a resonance frequency of the first feed element and the second feed element.

18. The multi-antenna according to claim 1, further comprising:

a first substrate; and a second substrate positioned such that the ground plane is interposed between the first substrate and the second substrate, wherein the first feeding point and the first feed element of the first antenna structure and the second radiating element of the second antenna structure are positioned on the first substrate, and the second feeding point and the second feed element of the second antenna structure and the first radiating element of the first antenna structure are positioned on the second substrate.

19. The multi-antenna according to claim 1, further comprising:

a first substrate; and a second substrate positioned such that the ground plane is interposed between the first substrate and the second substrate, wherein the first feeding point, the first feed element and the first radiating element of the first antenna structure are positioned on the first substrate, and the second feeding point, the second feed element and the second radiating element of the second antenna structure are positioned on the second substrate.

20. A radio apparatus, comprising:

a multi-antenna comprising a ground plane, a first antenna structure, and a second antenna structure such that the first antenna structure comprises a first feeding point positioned on a first surface of the ground plane, a first feed element connected to the first feeding point, and a first radiating element positioned to establish electromagnetic field coupling with the first feed element such that the first radiating element functions as a radiation conductor when power is supplied by the first feed element through the electromagnetic field coupling with the first feed element, and that the second antenna structure comprises a second feeding point positioned on a second surface of the ground plane, a second feed element connected to the second feeding point, and a second radiating element positioned to establish electromagnetic field coupling with the second feed element such that the second radiating element functions as a radiation conductor when power is supplied by the second feed element through the electromagnetic field coupling with the second feed element, wherein the first radiating element of the first antenna structure and the second radiating element of the second antenna structure are positioned on mutually different planes such that the first and second radiating elements intersect with respect to each other and that no ground conductive line is formed between the first and second radiating elements.

* * * * *